US012492054B2

(12) United States Patent
Zacherle et al.

(10) Patent No.: US 12,492,054 B2
(45) Date of Patent: Dec. 9, 2025

(54) ARTICLE ENGAGING STRUCTURE, ARTICLE CARRIER, AND BLANK FOR FORMING THE SAME

(71) Applicant: WestRock Packaging Systems, LLC, Atlanta, GA (US)

(72) Inventors: Matthew E. Zacherle, Moseley, VA (US); Cullen B. Rosenbrien, Richmond, VA (US); Ryan C. Bradfield, Henrico, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 14 days.

(21) Appl. No.: 18/292,606

(22) PCT Filed: Jul. 26, 2022

(86) PCT No.: PCT/US2022/038400

§ 371 (c)(1),
(2) Date: Jan. 26, 2024

(87) PCT Pub. No.: WO2023/009555

PCT Pub. Date: Feb. 2, 2023

(65) Prior Publication Data

US 2025/0042634 A1 Feb. 6, 2025

Related U.S. Application Data

(60) Provisional application No. 63/337,226, filed on May 2, 2022, provisional application No. 63/257,890, filed (Continued)

(51) Int. Cl.
*B65D 71/42* (2006.01)

(52) U.S. Cl.
CPC ..... *B65D 71/42* (2013.01); *B65D 2571/0066* (2013.01)

(58) Field of Classification Search
CPC ..... B65D 71/40; B65D 71/42; B65D 71/44; B65D 71/46; B65D 71/48; B65D 2571/066

(Continued)

(56) References Cited

U.S. PATENT DOCUMENTS 8,096,413 B2 * 1/2012 Coltri De Paula .... B65D 71/42 206/199

FOREIGN PATENT DOCUMENTS

| | | | |
|---|---|---|---|
| DE | 102009043843 | A1 | 3/2011 |
| WO | WO2010099164 | A2 | 9/2010 |
| WO | WO2021078431 | A1 | 4/2021 |

OTHER PUBLICATIONS

PCT/US2022/038400 International Search Report dated Jan. 13, 2023, 5 Pages.

* cited by examiner

*Primary Examiner* — Bryon P Gehman
(74) *Attorney, Agent, or Firm* — Brian J. Goldberg; Tsugihiko Suzuki; Rohini K. Garg

(57) ABSTRACT

Aspects of the disclosure relate to an article engaging device (390; 490; 590), an article carrier (90; 190) for packaging one or more articles and to a blank (10; 110; 210; 310; 410; 510) for forming the device or carrier. The device or carrier comprises a main panel (12; 112; 212; 312; 412; 512) including an article retention structure (RT; RT1, RT2) having an article receiving opening defined in part by a plurality of engaging teeth (40*a*, 40*b*, 40*c*, 40*d*, 40*e*; 140*b*, 140*c*, 140*e*; 240*b*, 246, 250; 340*a*, 340*c*, 340*e*; 440*a*, 440*c*, 440*e*; 540*a*, 540*e*, 540*f*). The article retention structures (RT; RT1, RT2) comprise a cover panel (14; 114; 214; 314; 414; 514) coupled to the main panel (12; 112; 212; 312; 412; 512) by at least one, two or more bridging strips (42; 142; 242; 342; 442; 542). Each bridging strip (42; 142; 242; 342; 442;

(Continued)

542) extends from an engaging or connecting tooth (40*c,* 40*d;* 140*c;* 240*c;* 340*c;* 440*c;* 540*e*) and is directly connected to the cover panel (14; 114; 214; 314; 414; 514).

20 Claims, 15 Drawing Sheets

Related U.S. Application Data on Oct. 20, 2021, provisional application No. 63/225, 905, filed on Jul. 26, 2021.

(58) Field of Classification Search
USPC ..... 206/427
See application file for complete search history.

ARTICLE ENGAGING STRUCTURE, ARTICLE CARRIER, AND BLANK FOR FORMING THE SAME

The present application is a 35 U.S.C. §§ 371 national stage application of PCT/US2022/038400 filed on 26 Jul. 2022, which claims the benefit of priority to U.S. Provisional Patent Application Ser. Nos. 63/337,226 filed 2 May 2022; 63/257,890 filed 20 Oct. 2021 and 63/225,905 filed on 26 Jul. 2021, the contents of each of which are incorporated herein by reference in their entirety.

TECHNICAL FIELD

The present invention relates to article engaging structures, article carriers and blanks for forming the same. More specifically, but not exclusively, the invention relates to a carrier of the top-gripping type having one or more apertures for receiving and retaining an article therein.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and are arranged about the aperture. The tabs are displaced out of the plane of said panel when an article is received in the aperture, wherein said tabs engage the article generally about a flange or lip of the article.

It is desirable to provide a cover to protect an upper end of the article or to provide a display panel for display of information.

The present invention seeks to provide an improvement in the field of packaging, of cartons, typically formed from paperboard or the like, and apparatus for assembly of said cartons.

SUMMARY

A first aspect of the invention provides an article engaging carrier for packaging at least one article. The carrier comprises a main panel having at least one article retention structure for engaging an article. The article retention structure has an article receiving opening defined in part by a plurality of engaging teeth and comprises a cover panel coupled to the main panel by at least one bridging strip. Each bridging strip extends from an engaging tooth and is directly connected to the cover panel.

Optionally, the article carrier comprises a stopper tab nested within at least a portion of the bridging strip.

Optionally, the bridging strip is directly connected in part to the main panel.

Optionally, the bridging strip extends radially outward of a notional circle defined by a hinged connection between the plurality of engaging teeth and the main panel.

Optionally, the bridging strip is disposed within a notional circle defined by a hinged connection between the plurality of engaging teeth and the main panel.

Optionally, the article carrier comprises at least one pair of diametrically opposed bridging strips.

A second aspect of the invention provides an article engaging carrier for packaging at least one article. The carrier comprises a main panel having at least two article retention structures for engaging an article. Each article retention structure has an article receiving opening defined in part by a plurality of engaging teeth and comprises a cover panel coupled to the main panel by at least one bridging strip. Each bridging strip extends from an engaging tooth and is directly connected to a respective cover panel. A bridging strip of a first one of the at least two article retention structures is disposed back-to-back with a bridging strip of a second one of the at least two article retention structures.

A third aspect of the invention provides an article engaging carrier for packaging at least one article. The carrier comprises a main panel having at least two article retention structures for engaging an article. Each article retention structure has an article receiving opening defined in part by a plurality of engaging teeth and comprises a cover panel coupled to the main panel by at least one bridging strip. Each bridging strip extends from an engaging tooth and is directly connected to a respective cover panel. The cover panel of a first one of the at least two article retention structures comprises a first stopper tab extending radially therefrom and the cover panel of a second one of the at least two article retention structures comprises a second stopper tab extending radially therefrom. The second stopper tab is disposed back-to-back with the first stopper tab.

A fourth aspect of the invention provides an article engaging carrier for packaging at least one article. The carrier comprises a main panel having at least one article retention structure for engaging an article. The article retention structure has a cover panel including at least one stopper tab for resting on an article rim and extending radially outward from the cover panel. The at least one stopper tab has an outer free end which is defined by a first end section of a first arcuate slit. The outer free end is adjoined by a bridging strip and is separated therefrom by the first end section.

A fifth aspect of the invention provides an article engaging carrier for packaging at least one article. The carrier comprises a main panel having at least one article retention structure for engaging an article. The article retention structure has a cover panel including at least one stopper tab having an outer free end defined by a first end section of a first arcuate slit. The outer free end is radially spaced apart from a second end section of a second opposing arcuate slit such that a bridging strip is defined between the first end section and the second end section.

A sixth aspect of the invention provides an article engaging carrier for packaging at least one article. The carrier comprises a main having a top engaging device comprising a pair of opposing, generally, arcuate slits. A first end section of the first slit is disposed at a position radially inside of a second end section of the second slit and a second end section of the first slit is disposed at a position radially outside of a first end section of the second slit.

A seventh aspect of the invention provides a blank for forming an article carrier. The blank comprises a main panel having at least one article retention structure for engaging an article. The article retention structure has an article receiving opening defined in part by a plurality of engaging teeth and comprises a cover panel coupled to the main panel by at least one bridging strip. Each bridging strip extends from an engaging tooth and is directly connected to the cover panel.

An eighth aspect of the invention provides a blank for forming an article carrier. The blank comprises a main panel having at least two article retention structures for engaging an article. Each article retention structure has an article receiving opening defined in part by a plurality of engaging teeth and comprises a cover panel coupled to the main panel by at least one bridging strip. Each bridging strip extends from an engaging tooth and is directly connected to the cover panel. A bridging strip of a first one of the at least two article retention structures is disposed back-to-back with a bridging strip of a second one of the at least two article retention structures.

A ninth aspect of the invention provides a blank for forming an article carrier. The blank comprises a main panel having at least two article retention structures for engaging an article. Each article retention structure has an article receiving opening defined in part by a plurality of engaging teeth and comprises a cover panel coupled to the main panel by at least one bridging strip. Each bridging strip extends from an engaging tooth and is directly connected to the cover panel. The cover panel of a first one of the at least two article retention structures comprises a first stopper tab extending radially therefrom and the cover panel of a second one of the at least two article retention structures comprises a second stopper tab extending radially therefrom, the second stopper tab being disposed back-to-back with the first stopper tab.

A tenth aspect of the invention provides a blank for forming an article carrier. The blank comprises a main panel having at least one article retention structure for engaging an article. The article retention structure has a cover panel including at least one stopper tab for resting on an article rim and extending radially outward from the cover panel. The at least one stopper tab has an outer free end which is defined by a first end section of a first arcuate slit. The outer free end is adjoined by a bridging strip and is separated therefrom by the first end section.

An eleventh aspect of the invention provides a blank for forming an article carrier. The blank comprises a main panel having at least one article retention structure for engaging an article. The article retention structure has a cover panel including at least one stopper tab having an outer free end defined by a first end section of a first arcuate slit. The outer free end is radially spaced apart from a second end section of a second opposing arcuate slit such that a bridging strip is defined between the first end section and the second end section.

A twelfth aspect of the invention provides a blank for forming an article carrier. The blank comprises a main panel having a top engaging device comprising a pair of opposing, generally, arcuate slits. A first end section of the first slit is disposed at a position radially inside of a second end section of the second slit and a second end section of the first slit is disposed at a position radially outside of a first end section of the second slit.

Optionally, the at least one bridging strip has an inner end which is connected to the cover panel, and wherein the inner end is disposed within a notional circle defined by a hinged connection between the plurality of engaging teeth and the main panel.

Optionally, the inner end adjoins one of the engaging teeth when the article carrier is in a blank form.

Optionally, the at least one bridging strip has an outer end opposite to the inner end, wherein the at least one bridging strip is connected at the outer end to the at least one of the engaging teeth and wherein the inner end is disposed closer to a centre of the article receiving opening than the outer end.

A thirteenth aspect of the invention provides an article engaging device for engaging at least one article. The device comprises a main panel having at least one article engaging structure for engaging at least one article. The at least one article engaging structure has an article receiving opening defined in part by a plurality of engaging teeth and comprises a cover panel coupled to the main panel by at least one bridging strip. The at least one bridging strip extends from at least one of the engaging teeth and is directly connected to the cover panel.

Optionally, the device forms a carrier for carrying at least one article.

Optionally, the device forms a tag wherein the at least one article engaging structure forms a cap for at least partially closing an orifice of an article.

Optionally, the cap is detachably mounted to the main panel such that upon detachment of the cap, the remainder of the main panel provides a collar surrounding the orifice of the article.

A fourteenth aspect of the invention provides a blank for forming a device for engaging at least one article. The device comprises a main panel having at least one article engaging structure for engaging an article. The at least one article engaging structure has an article receiving opening defined in part by a plurality of engaging teeth and comprises a cover panel coupled to the main panel by at least one bridging strip. The at least one bridging strip extends from at least one of the engaging teeth and is directly connected to the cover panel.

A fifteenth aspect of the invention provides a dust cap for protecting a port of an article. The dust cap comprises a main panel having at least one article engaging structure for engaging the port. The at least one article engaging structure has an article receiving opening defined in part by a plurality of engaging teeth and comprises a cover panel coupled to the main panel by at least one bridging strip. The at least one bridging strip extends from at least one of the engaging teeth and is directly connected to the cover panel.

Optionally, the article is a keg for a beverage.

A sixteenth aspect of the invention provides an article engaging device for engaging at least one article. The article engaging device comprises a main panel having an engaging structure. The engaging structure comprises a top-receiving opening, defined in part by a plurality of engaging teeth disposed partially around the top-receiving opening, and a cover panel, struck from the main panel to define the top-receiving opening, at least in part. The engaging structure comprises at least a pair of first and second non-linear slits each comprising first and second opposite end sections and an intermediate section. The first end section of the first slit is disposed at a position radially inside of the second end section of the second slit (that is to say the first end section of the first slit is closer to the centre of the top-receiving opening than the second end section of the second slit). The intermediate section of each of the first and second non-linear slits defines a radially inner end of at least one of the engaging teeth.

Optionally, the first and intermediate sections of each of the first and second non-linear slits define part of the cover panel.

Optionally, an inner end of at least one of the engaging teeth is a free end edge distal from a hinged connection to the main panel.

Optionally, the first end section of the first slit and the second end section of the second slit extend alongside one another to define a bridging strip therebetween for connecting between the cover panel and one of the main panel and one of the engaging teeth.

Optionally, at least part of the bridging strip extends generally circumferentially with respect to the top-receiving opening.

Optionally, the at least one of the engaging teeth has a side edge defined by a radial cut extending radially with respect to the top-receiving opening, and wherein the radial cut extends from the intermediate section of a respective one of the first and second non-linear slits.

Optionally, the first non-linear slit comprises a branch section extending from the first end section of the first non-linear slit, at least part of the branch section being disposed at a position radially outside of the second end section of the second slit and extending therealongside.

Optionally, the cover panel comprises at least one stopper tab for resting on an article rim, the at least one stopper tab extending radially outward from the cover panel and being defined at least in part by the first end section of the first non-linear slit.

Optionally, the bridging strip comprises a first circumferential section defining a portion of the cover panel, and a second circumferential section disposed adjacent to the first circumferential section.

Optionally, the bridging strip comprises a radial section coupling the second circumferential section to the first circumferential section.

Optionally, the bridging strip comprises a recess for engaging a portion of an article.

Optionally, the bridging strip comprises a recess for receiving a radially projecting portion of an article.

Optionally, the recess is defined, at least in part, by the stopper tab.

Optionally, the recess is separated from the stopper tab by a portion of the first end section of a respective one of the first and second slit.

Further features and advantages of the present invention will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of engaging structures, packages, blanks, and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the engaging structures, packages, blanks, and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
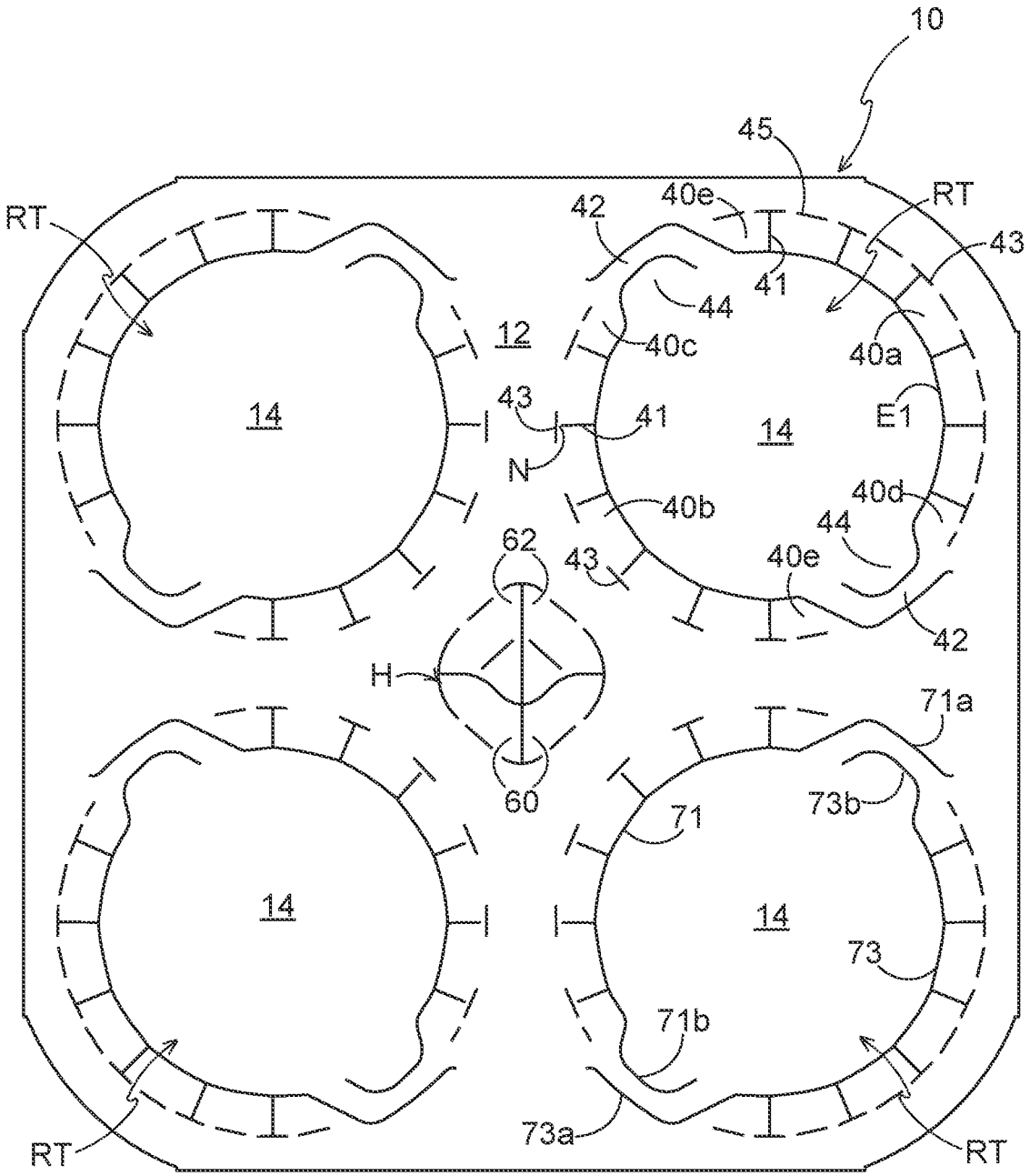
FIG. 1 is a plan view from above of a blank for forming a carrier according to an embodiment of the present disclosure.
Figure 2:
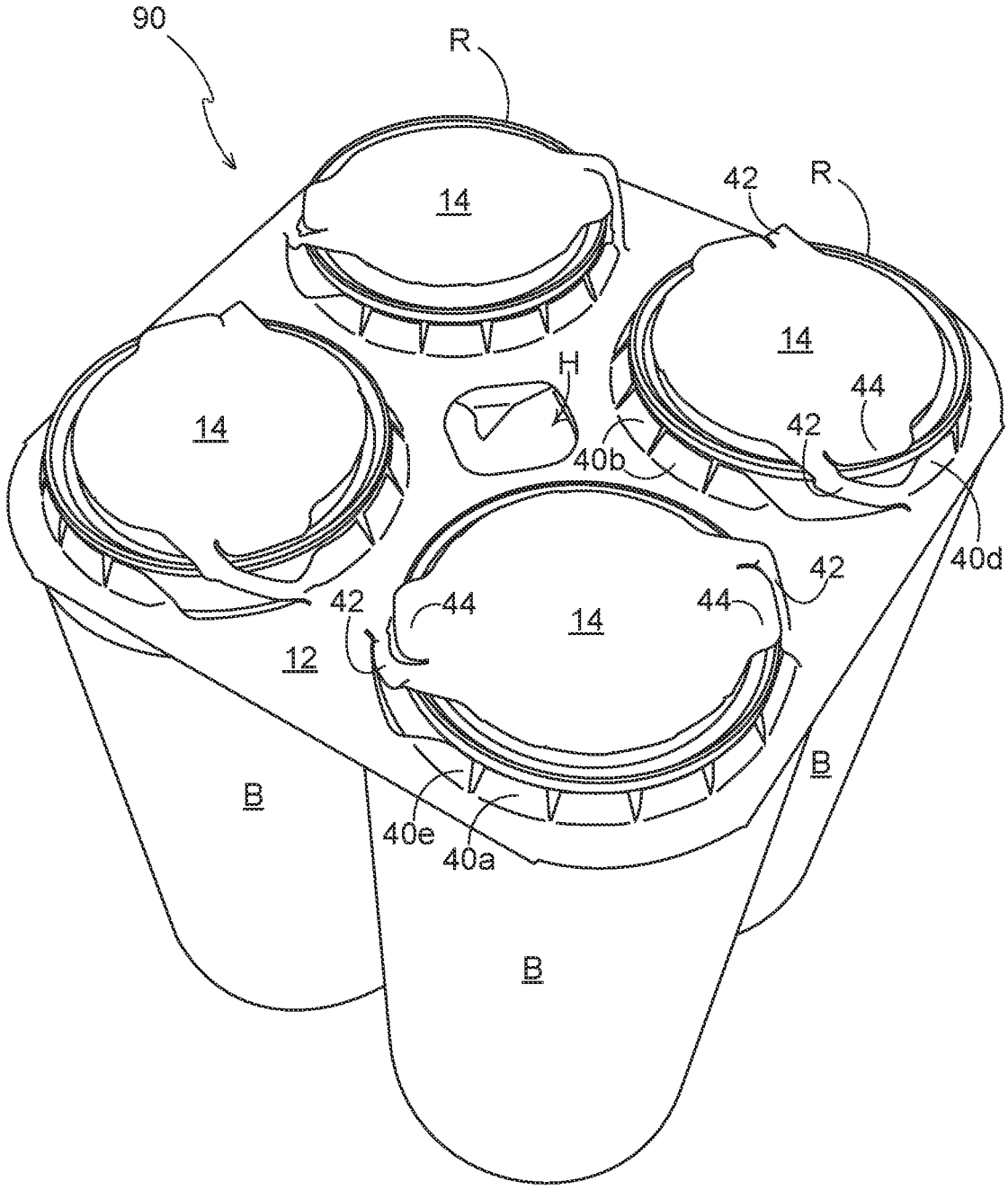
FIG. 2 is a perspective view from above of a carrier formed from the blank of FIG. 1.
Figure 4:
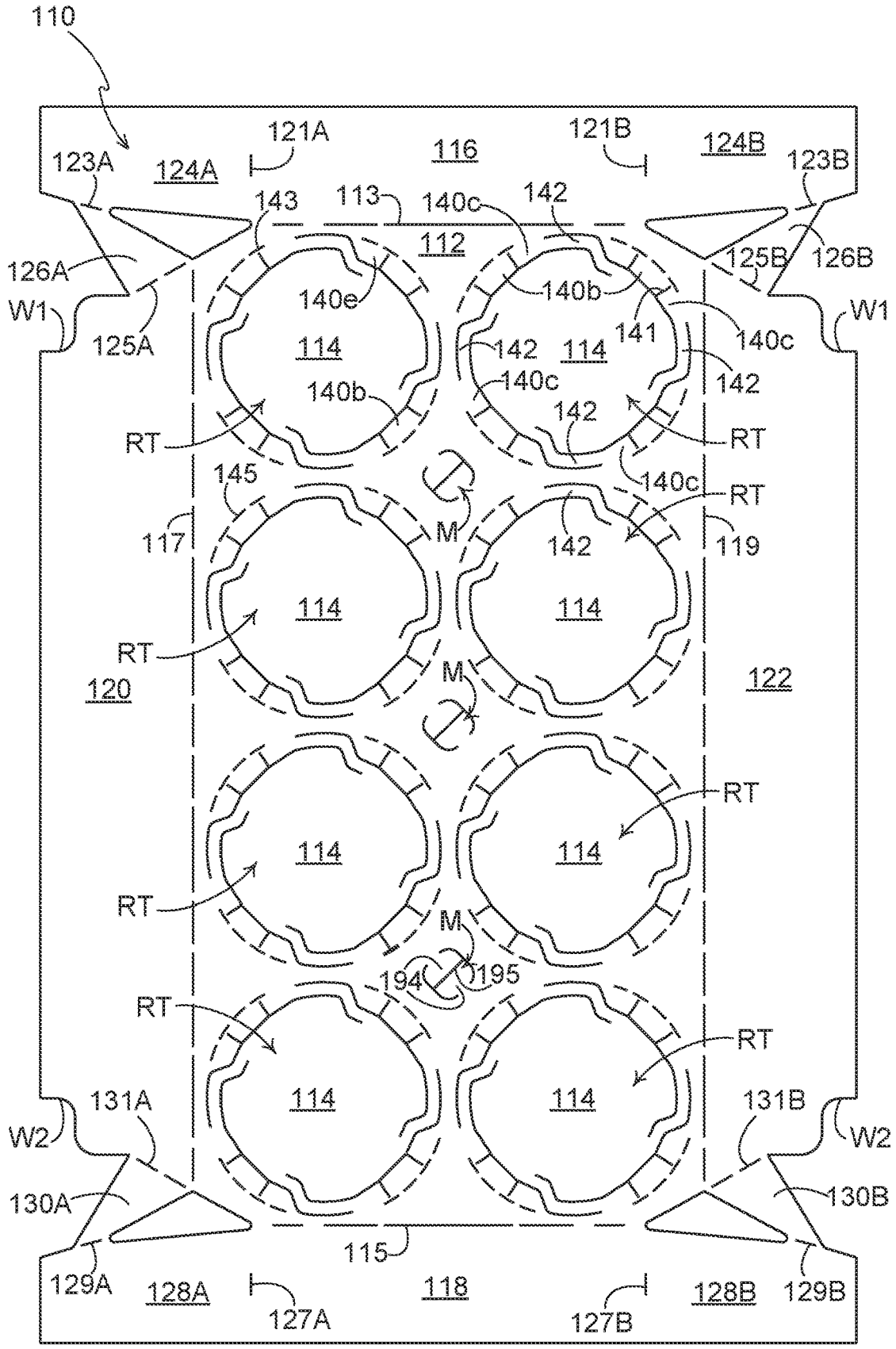
FIG. 4 is a plan view from above of a blank for forming a carrier according to another embodiment of the present disclosure.
Figure 6:
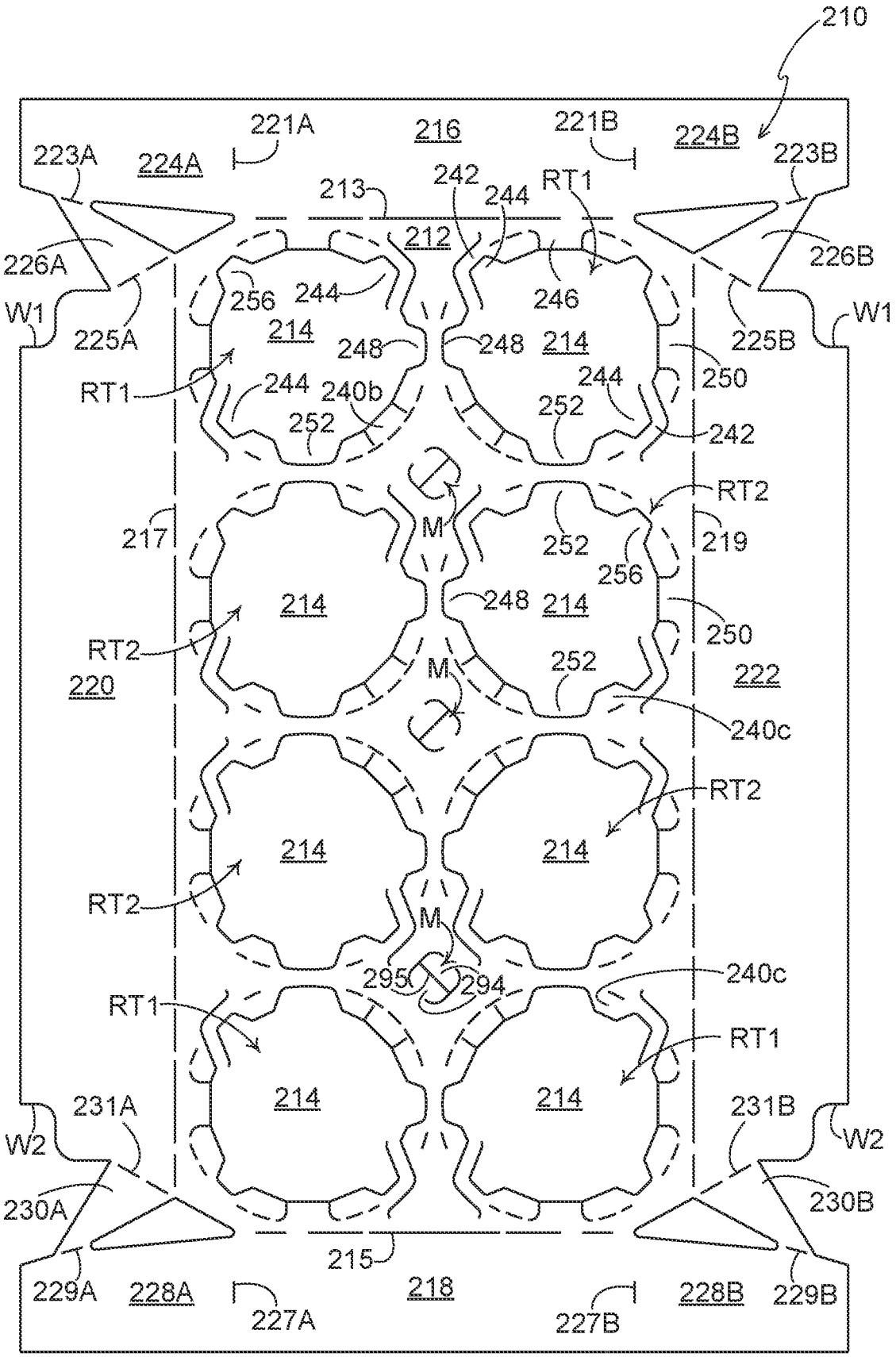
FIG. 6 is a plan view from above of a blank for forming a carrier according to a further embodiment of the present disclosure.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B, as shown in FIG. 2. The articles B may be generally cylindrical; the articles B may comprise a circular cross-sectional shape, at least about a region of engagement with the carrier 90. The blank 10 forms a secondary package for packaging at least one primary product container or package. Alternative blanks 110; 210 are shown in FIGS. 4 and 6 for forming an alternative cartons or carriers 190.

Further alternative blanks 310; 410; 510 are shown in FIGS. 7A, 7B, 9A, 9B, and 13 for forming packages or devices 390; 490; 590 as shown in FIGS. 8, 10, 11 and 14.

In the embodiments detailed herein, the terms "carton" and "carrier" refer, for the non-limiting purpose of illustrating the various features of the invention, to a container for engaging and/or carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets, and the like.

The blanks 10; 110; 210; 310; 410; 510 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

Figure 3:
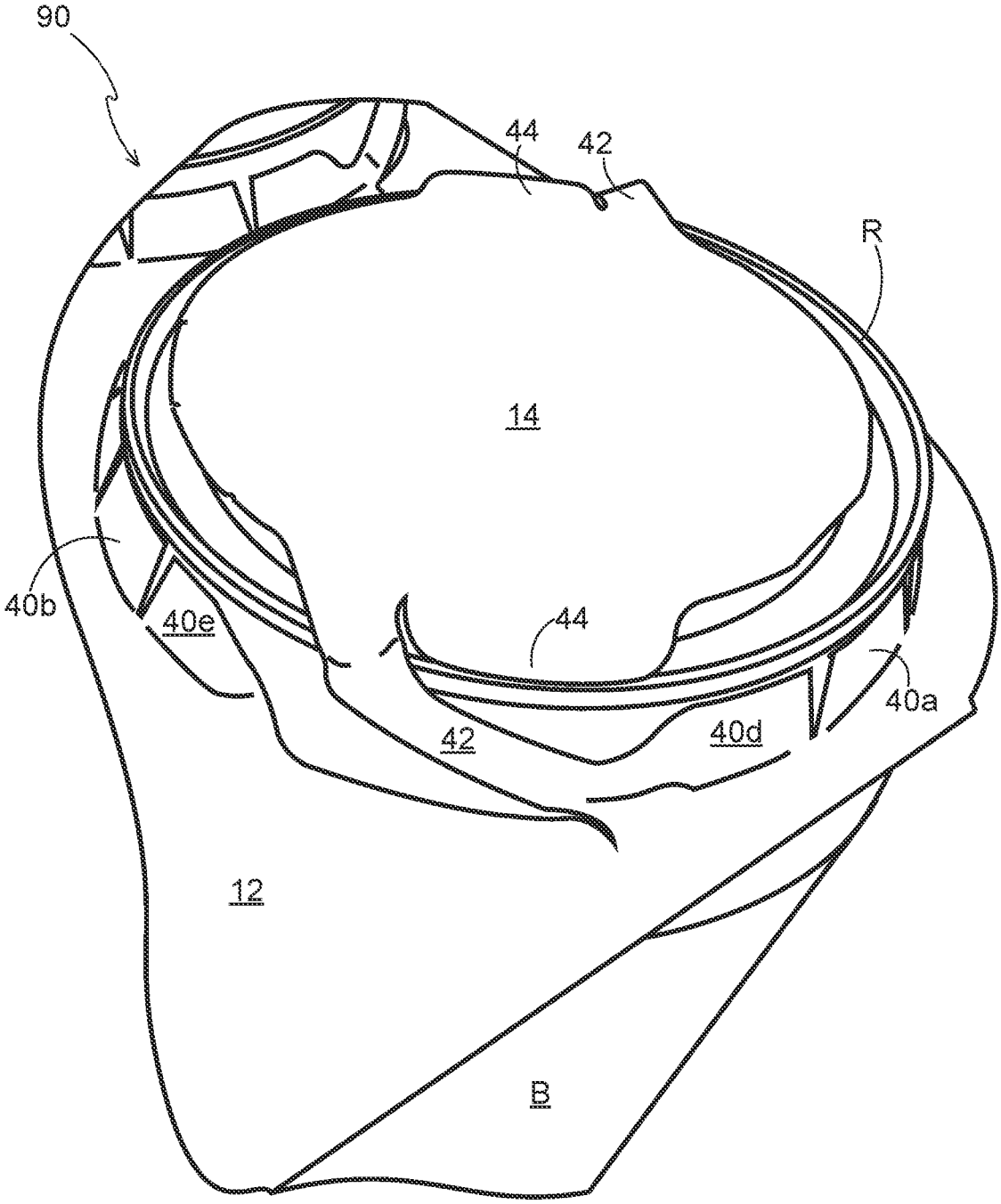
FIG. 3 is an enlarged perspective view from above of a portion of the carrier of FIG. 2.

In the illustrated embodiments, the blanks 10; 110; 210 are configured to form a carton or carrier 90; 190 for packaging an exemplary arrangement of exemplary articles B. In the illustrated embodiment of FIGS. 1 to 3, the arrangement is a 2×2 matrix or array-two rows of two articles B are provided—and the articles B are beverage cans. In the illustrated embodiments of FIGS. 4 to 6, the arrangement is a 2×4 matrix or array-two rows of four articles B are provided—and the articles B are beverage cans of a sleek or slim design. Alternatively, the blanks 10; 110; 210 can be configured to form a carrier for packaging other types, number, and size of articles and/or for packaging articles in a different arrangement or configuration. The blanks 310; 410; 510 are configured to form a package or device 390; 490; 590 with a single article B in the form of a barrel or keg such as, but not limited to, the type of barrel or keg used in the brewing industry.

Figure 5:
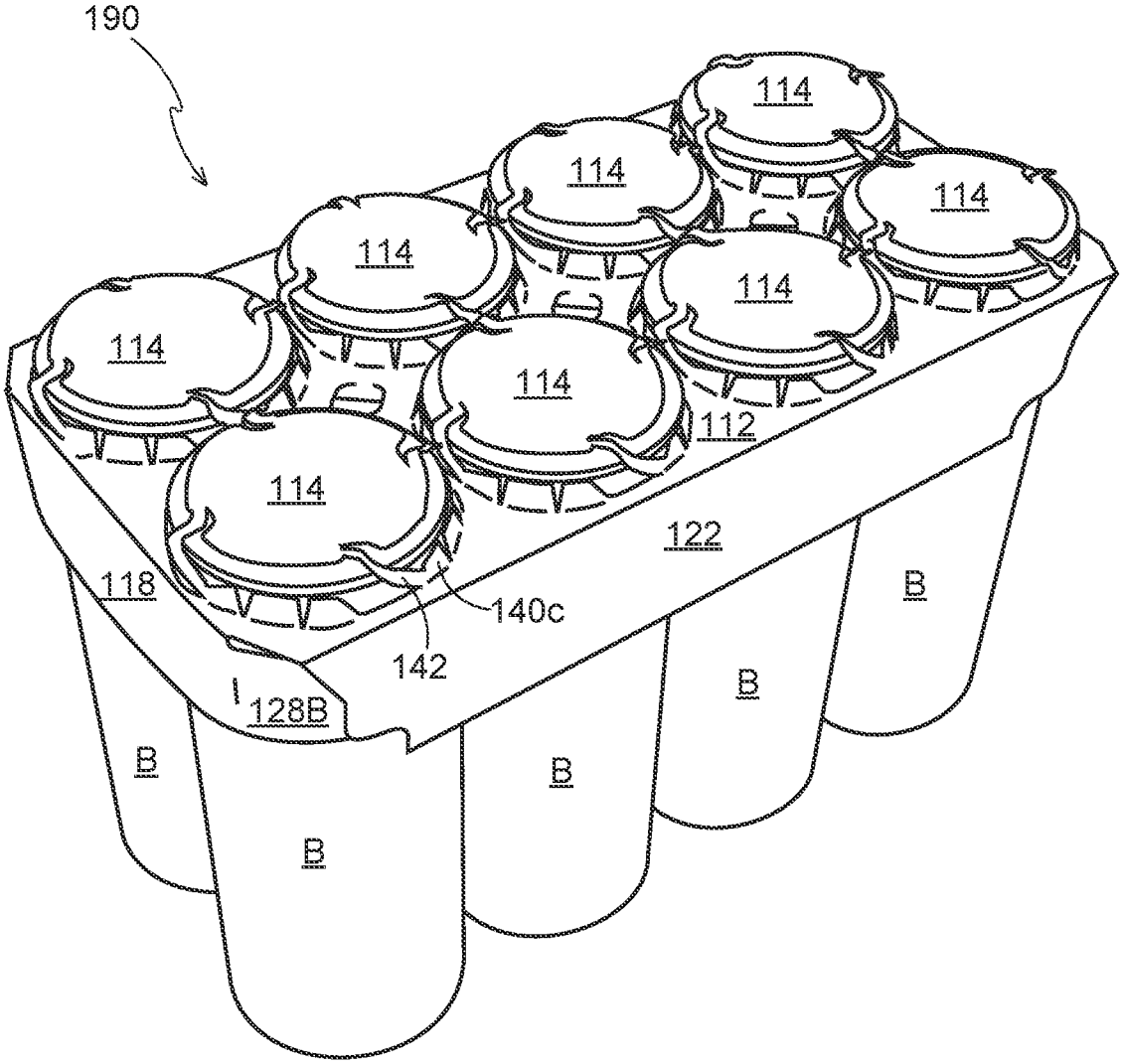
FIG. 5 is a perspective view from above of a carrier formed from the blank of FIG. 4.

In the embodiments illustrated in FIGS. 4 to 6 the blanks 110; 210 are configured to accommodate beverage cans of the sleek or slim design that may be 330 ml cans. The articles B are substantially of the same diameter over their entire height. An exemplary article B has a maximum diameter or lateral dimension (the diameter may be about 2.25 inches or about 58 mm). The article B comprises an upper portion or top closure which has a diameter or lateral dimension (the diameter may be about 2.125 inches or 54.8 mm).

The neck may provide an outwardly projecting flange, that is to say it may comprise an undercut for engaging with the carrier. A top closure may be attached to the side wall of the article B to form a seam or "chime" which provides the flange. In some embodiments the variation in diameter between the top closure and the main body of the article B is less than 7 mm, may be less than 5 mm and optionally is less than 4 mm.

As used herein the terms "sleek" or "slim" refer to articles B which have little or no variation in their lateral dimension between the top closure which engages with the carrier 90; 190 and the main body of the article B. The articles B are substantially parallel sided or of substantially uniform diameter.

Referring to FIG. 1 there is shown a blank 10 comprising a main or engaging panel 12 for forming a top wall or an engaging panel of a carrier 90 (see FIG. 2).

The main panel 12 includes at least one article retention structure RT, also referred to herein as an article engagement structure. In the illustrated embodiment, the main panel 12 comprises a plurality of article retention structures RT specifically four article retention structures arranged in 2×2 matrix or array. The main panel 12 comprises two columns of article retention structures RT, each column comprises two article retention structures RT. The main panel 12 comprises two rows of article retention structures RT, each row comprises two article retention structures RT. Each of the article retention structures RT forms an opening for receiving a portion of an article B.

Each of the first article retention structures RT is substantially similar in construction and will therefore be described in detail with reference to one of the first article retention structures RT located adjacent to a first end of the blank 10 as shown in FIG. 1.

The article retention structure RT comprises an article receiving opening defined in part by a cover panel 14.

The article retention structure RT comprises a plurality of engaging teeth 40*a*, 40*b*, 40*c*, 40*d*, 40*e* disposed about the cover panel 14 and defining a perimeter of the article receiving opening.

The plurality of teeth 40*a*, 40*b*, 40*c*, 40*d*, 40*e* are hinged to the main panel 12 by a fold line. The fold line may be defined by a plurality of cut lines 43, 45. The plurality of cut lines 43, 45 may define or approximate a circle or part thereof.

The article retention structure RT may comprise a plurality of first full teeth 40*a* and a plurality of second full teeth 40*b* disposed about the cover panel 14. Each first tooth 40*a* and second tooth 40*b* comprises an engaging edge E1 opposing a hinged edge. The engaging edges E1 are defined by a linear portion of a cut line defining the cover panel 14. Each engaging edge E1 defines a part of a polygon such as but not limited to a hexadecagon. In some embodiments, the cut line defining the cover panel 14 may be arcuate, at least in part, in shape. Each full tooth 40*a*, 40*b* comprises a pair of side edges, the side edges are defined by cut lines 41 extending radially outward from respective vertices of the polygon. That is to say from a respective vertex between a pair of adjacent linear portions of the cut line defining the cover panel 14. The cut lines 41 are divergently arranged with respect to each other and define an angle therebetween, the angle may be about 22.5°.

The article retention structure RT may comprise a plurality of first circumferential cut lines 43. Each of the plurality of first circumferential cut lines 43 is aligned with one of the radial cut lines 41 such that said one of the radial cut lines 41 or a notional extension thereof bisects a respective one of the plurality of first circumferential cut lines 43.

The first full teeth 40*a* may comprise a pair of first circumferential cut lines 43 that intersect with the respective radial cut line 41 bisecting it such that said first tooth 40*a* is separated from its adjacent neighbours.

The second full teeth 40*b* may comprise at least one first circumferential cut line 43 that is spaced apart from a respective radial cut line 41 bisecting it so as to define a connecting nick or bridge portion N between a pair of adjacently disposed teeth 40*a*, 40*b*, 40*c*, 40*d*, 40*e*.

Each of the plurality of first circumferential cut lines 43 may be linear in shape. Alternatively, each of the plurality of first circumferential cut lines 43 may be non-linear or arcuate in shape.

The article retention structure RT may comprise a plurality of second circumferential cut lines 45. Each of the plurality of second circumferential cut lines 45 is disposed between a pair of the plurality of first circumferential cut lines 43 and is spaced apart therefrom so as to define a pair of connecting nick or bridge portions between a tooth 40*a*, 40*c*, 40*d*, 40*e* and the main panel 12. The pair of connecting nick or bridge portions provide a hinged or foldable connection between each tooth 40*a*, 40*b*, 40*c* and the main panel 12. The second circumferential cut lines 45 are omitted from the second full teeth 40*b*, which are generally disposed towards or in inner, or central, regions of the main panel 12. The first full teeth 40*a* are generally disposed in outer or marginal regions of the main panel 12.

Each of the plurality of second circumferential cut lines 45 may be linear in shape. Alternatively, each of the plurality of second circumferential cut lines 45 may be non-linear or arcuate in shape.

The article retention structure RT comprises at least one, two or more connecting teeth 40*c*, 40*d*. The illustrated embodiment comprises a pair of connecting teeth 40*c*, 40*d*, each is coupled or connected to a bridging or connecting portion 42. In the illustrated embodiment, a first or proximal end of the bridging or connecting portion 42 is coupled in part to a connecting tooth 40*c*, 40*d* and in part to the main panel 12. The first end of the bridging or connecting portion 42 may be connected to a side edge of a connecting tooth 40*c*, 40*d*; the side edge being disposed adjacent to an engaging edge of the connecting tooth 40*c*, 40*d*. A second or distal end of the bridging or connecting portion 42 is coupled or connected directly to the cover panel 14. The bridging or connecting portion 42 may be substantially "L" or "V" shaped. The bridging or connecting portion 42 comprises a generally radially extending section and a generally circumferential extending portion.

The cover panel 14 comprises at least one stopper tab 44 providing an end stop against which the article B may abut. The stopper tab 44 may abut or engage a rim or chime of the article B. In the illustrated embodiment, the blank 10 comprises a plurality of stopper tabs 44, specifically, but not limited to, two stopper tabs 44. The pair of stopper tabs 44 are arranged to be substantially opposite each other, that is to say they are diametrically opposed.

The bridging or connecting portion 42 may be arranged to extend beyond a notional circle defining the hinged connection between the plurality of teeth 40*a*, 40*b*, 40*c*, 40*d*, 40*e* and the main panel 12. That is to say the bridging or connecting portion 42 extends radially outward beyond the footprint of the plurality of teeth 40*a*, 40*b*, 40*c*, 40*d*, 40*e*. A portion 71*a*, 73*a* of a cutline 71, 73 defining an outermost edge of the connecting portion 42 is disposed outside the notional circle defining said hinged connection.

Optionally, the cutline defining an outermost edge of the connecting portion 42 may comprises a "J" or "C" shaped cut terminating an outer end thereof to provide a tear control feature. The cut may diverge away from the hinged connection of the connecting tab 40*c*, 40*d*.

At least a portion of a cutline 71*b*, 73*b* defining an inner edge of the connecting portion 42 also defines, at least in part, the stopper tab 44; the connecting portion 42 and the stopper tab 44 share a common cutline. The stopper tab 44 is nested or tessellated within the connecting portion 42. The stopper tab 44 is disposed, at least in part, between a radially extending portion of the connecting portion 42 and the connecting tab 40*c*, 40*d* to which the connecting portion 42 is connected.

A partial tooth 40*e* may abut, or be disposed adjacent to, the radially extending portion of the connecting portion 42.

In the illustrated embodiment, the radius of curvature of each of the plurality of second circumferential cut lines 45 is equal to the radius of curvature of each of the plurality of first circumferential cut lines 43 however in other embodiments it may be different.

The blank 10 may comprise a handle structure H. The handle structure H may comprise a handle or finger opening disposed on a longitudinal axis bisecting the main panel 12. The handle opening may be provided between the group of four article retention structures RT. In the illustrated embodiment, the handle opening is disposed centrally of the main panel 12. The handle opening may be located at the centre of the group of four article retention structures RT.

The handle opening is defined by a plurality of tabs 60, 62. The handle opening comprises four tabs 60, 62. Each tab 60, 62 is hinged to the main panel 12 by a hinged connection in the form of a fold line. An arcuate or curvilinear cut line may be provided between each fold line to define a corner or vertex of the handle opening. The handle opening is substantially rhombus or diamond shaped, in other embodiments other shapes may be employed such as, but not limited to square. The handle opening comprises a pair of major tabs 60 and a pair of minor tabs 62.

The pair of major tabs 60 are separated from each other by a first cut line or severable line. The pair of minor tabs 62 are separated from each other by the first cut line or severable line.

The pair of major tabs 60 are separated from the pair of minor tabs 62 by a second cut line or severable line.

The first cut line is colinear with a notional line bisecting the group of four article retention structures RT.

The first cut line may be linear in shape and may extend between a first pair of opposed vertices of the handle opening.

The second cut line may be non-linear in shape and may extend between a second pair of opposed vertices of the handle opening. The second cut line intersects the first cutline, the second cut line comprises a "V" or "U" shaped medial portion; a vertex of the "V" or "U" shaped portion intersects the first cutline.

One of the pair of major tabs 60 is hinged to the main panel 12 by a first fold line. The other one of the pair of major tabs 60 is hinged to the main panel 12 by a second fold line. The first fold line is divergently arranged with respect to the second fold line.

One of the pair of minor tabs 62 is hinged to the main panel 12 by a third fold line. The other one of the pair of minor tabs 62 is hinged to the main panel 12 by a fourth fold line. The third fold line is divergently arranged with respect to the fourth fold line.

The first fold line is divergently arranged with respect to the third fold line. The second fold line is divergently arranged with respect to the fourth fold line.

Each of the pair of major tabs 60 may comprise a fold line extending thereacross. The fold line may be substantially parallel to the fold line hinging the respective one of the pair of major tabs 60 to the main panel 12. The fold line may extend between the first cut line or severable line and the second cut line or severable line. The fold lines across the pair of major tabs 60 may define a "V" shaped fold arranged in opposition to the V" or "U" shaped medial portion of the second cut line.

Referring now to FIGS. 4 to 6 there is shown additional embodiments of the present disclosure. In the illustrated embodiments, like numerals have, where possible, been used to denote like parts, albeit with the addition of the prefix "100"; "200" to indicate that these features belong to the second and third embodiments respectively. The alternative embodiments share many common features with the embodiment of FIGS. 1 to 3, therefore only the differences from the embodiment illustrated in FIGS. 1 to 3 will be described in any greater detail.

FIG. 4 shows a blank 110 comprising a plurality of main panels 112, 116, 118, 120, 122 including a first main panel 112 for forming a top wall or engaging panel 112 of a carrier 190 (see FIG. 5).

The first main panel 112 comprises at least one article retention structure RT. The main panel 112 comprises a plurality of article retention structures RT, specifically eight article retention structures RT arranged in 2×4 matrix or array. Each of the article retention structures RT comprises a cover panel 114.

The article retention structures RT of FIG. 4 are substantially similar to those of FIG. 1 albeit four connecting tabs 140*c* are provided and a bridging or connecting portion 142 is connected to, or integral with, a respective one of the connecting tabs 140*c*. The connecting portions 142 are smaller in a radial direction or dimension such that the connecting portions 142 are disposed within the footprint of the plurality of teeth 140*b*, 140*c*. The plurality of connecting portions 142 are arranged in pairs of diametrically opposed connecting portions 142. A second full tooth 140*b* and a partial tooth 140*e* is disposed between a pair of adjacently disposed connecting portions 142.

The connecting portions 142 are arranged such that a connecting portion 142 of a first article retention structures RT is back-to-back with, or adjacent to, a connecting portion 142 of a second, adjacently disposed (laterally or longitudinally) article retention structures RT. In this way no engaging teeth 140*b*, 140*c*, 140*e* are provided on, or about, the circumference or perimeter of the article retention structures RT in the region between pairs of laterally or longitudinally adjacent article retention structures RT where the pairs of laterally or longitudinally adjacent article retention structures RT are in closest proximity.

A portion of the cut line defining an outer edge or perimeter of the connecting portions 142 may define, or lie upon, a notional circle defined by the hinged connection between the engaging teeth 140*b*, 140*c*, 140*e* and the first main panel 112.

In the embodiment of FIG. 4, the second circumferential cut lines 145 have been omitted.

A second main panel 116 forms a first end panel 116 and is hingedly connected to a first end of the first main panel 112 by a hinged connection in the form of a fold line 113.

A third main panel 122 forms a second end panel 118 and is hingedly connected to a second, opposing, end of the first main panel 112 by a hinged connection in the form of a fold line 115.

A fourth main panel 120 forms a first side panel 120 and is hingedly connected to a first side of the first main panel 112 by a hinged connection in the form of a fold line 117.

A fifth main panel 122 forms a second side panel 122 and is hingedly connected to a second, opposing, side of the first main panel 112 by a hinged connection in the form of a fold line 119.

The blank 110 comprises a first end structure. The first end structure comprises the first end panel 116. The first end structure comprises a first corner panel 124A hingedly connected to a first end of the first end panel 116 by a hinged connection in the form of a fold line 121A. A second corner panel 124B is hingedly connected to a second, opposing, end of the first end panel 116 by a hinged connection in the form of a fold line 121B.

The first end structure comprises a first web panel 126A hingedly connected at one end to the first corner panel 124A by a hinged connection in the form of a fold line 12A and hingedly connected at a second end to the first side panel 120 by a hinged connection in the form of a fold line 125A.

A second web panel 126B is hingedly connected at one end to the second corner panel 124B by a hinged connection in the form of a fold line 123B and is hingedly connected at a second end to the second side panel 122 by a hinged connection in the form of a fold line 125B.

The blank 110 comprises a second end structure. The second end structure comprises the second end panel 118. The second end structure comprises a third corner panel 128A hingedly connected to a first end of the second end panel 118 by a hinged connection in the form of a fold line 127A. A fourth corner panel 128B is hingedly connected to a second, opposing, end of the second end panel 118 by a hinged connection in the form of a fold line 127B.

The second end structure comprises a third web panel 130A hingedly connected at one end to the third corner panel 128A by a hinged connection in the form of a fold line 129A and hingedly connected at a second end to the first side panel 120 by a hinged connection in the form of a fold line 131A.

A fourth web panel 130B is hingedly connected at one end to the fourth corner panel 128B by a hinged connection in the form of a fold line 129B and is hingedly connected at a second end to the second side panel 122 by a hinged connection in the form of a fold line 131B.

It will be appreciated that the first end panel 116, the first corner panel 124A, and the second corner panel 125A, form a first strap 124A/116/24B along a first end of the main panel 112. The second end panel 118, the third corner panel 128A, and the fourth corner panel 124B form a second strap 128A118/128B along a second end of the main panel 112.

The blank 110 may comprise at least one alignment or registration device W1, W2; in some embodiments blank 110 may comprise at least two alignment or registration devices W1, W2. Each of the registration devices W1, W2 takes the form of a cutaway or recess defining a registration edge of the blank 110 for receiving or engaging a reference pin (discussed in greater detail below). The blank 110 comprises a pair of first registration devices W1 each defining a downstream or leading registration edge. The blank 110 may also comprise a pair of registration devices W2 each defining an upstream or trailing registration edge.

Each of the cutaways or recesses, defining a registration devices W1, W2, is struck from one of the first and second side panels 120, 122. The alignment or registration devices W1, W2 may be employed during assembly of the blank 110 into an article carrier 190 and may be engaged by a suitable machine tool to align the blank with respect to a group of articles B.

The blank 110 may comprise at least one stabilisation device M. In the illustrated embodiment, the blank 110 comprises two stabilisation devices M. The stabilization device M takes the form of an opening struck from the blank 110. A first stabilisation device M is disposed between first group of four article retention structures RT located proximate a first or leading end edge of the blank 110 and may be disposed centrally between said group of article retention structures RT. A second stabilisation device M is disposed between a second group of four article retention structures RT located proximate a second or trailing end edge of the blank 110 and may be disposed centrally between said group of article retention structures RT. The stabilisation devices M are configured to receive an abutment peg during application of the blank 110 to a group of articles B. The abutment peg stabilises or secures the blank 110 when the side and end panels 120, 122, 116, 118 are folded about the group of articles B and the registration devices W1, W2 are disengaged from their respective machine tool during assembly of the blank 110 into an article carrier 190.

The opening of the stabilisation devices M may be non-circular in shape, and may be substantially square or diamond shaped. The opening may be defined by at least one tab 194 struck from the main panel 112 and hingedly connected thereto. In the illustrated embodiment, the opening is defined by a pair of tabs 194 each struck from the main panel 112 and hingedly connected to the main panel 112 in opposition to each other. The pair of tabs 194 may be separated from each other by a cut or severable line 195.

In some embodiments, the stabilisation devices M may be arranged to provide an additional handle opening. In the embodiment of FIG. 4, the stabilisation devices M are generally too small in dimension to accept a finger or portion thereof of a user's finger. This may be advantageous in that a greater amount of substrate material is provided in the main panel 112 between the stabilisation devices M and the of article retention structures RT, whereby improving the robustness and integrity of the article carrier 190.

The end structures of the blank 110 are folded to secure the first and second end panels 116, 118 about sides of a group of articles B. The blank 110 can be applied to the group of articles B in a flat form and folded thereabout.

The main panel 112 is lowered with respect to a group of articles B. The first and second end panels 116, 118 are folded about the opposing sides of the group of articles B. The corner panels 124A, 124B, 128A, 128B are folded about the corners of the group of articles B.

The first and second side panels 120, 122 are folded downwards about a respective side of the group of articles B to be brought into face contacting relationship with a portion of the corner panels 124A, 124B, 128A, 128B and secured thereto by adhesive.

Referring now to FIG. 6 there is shown a blank 210 according to a third embodiment of the disclosure. The blank 210 comprises a plurality of main panels 212, 216, 218, 220, 222 in a substantially similar arrangement to the blank 110 of FIG. 4, and includes a first main panel 212 for forming a lower wall or engaging panel of a carrier (not shown).

The main panel 212 of the blank 210 includes at least one article retention structure RT1, RT2. The main panel 212 comprises a plurality of article retention structures RT1, RT2, specifically eight article retention structures RT1, RT2 arranged in 2×4 matrix or array. Each of the article retention structures RT1, RT2 comprises a cover panel 214. The article retention structures RT1, RT2 are substantially similar to those shown in FIG. 1 albeit the cover panel 214 comprises additional stopper tabs 248, 252, 256.

The blank comprises four outer, or endmost, article retention structures RT1 and four intermediate article retention structures RT2. The endmost article retention structures RT1 comprise three additional stopping tabs 248, 252, 256.

A first stopper tab 248 is disposed opposite a first engaging tab 250, the first engaging tab 250 is disposed adjacent to one of the first and second side panels 220, 222. The first stopper tab 248 of a first endmost article retention structure RT1 is disposed back-to-back with a first stopper tab 248 of a second, adjacent, endmost article retention structure RT1 each defining a recess in the article receiving opening of the respective endmost article retention structure RT1.

A second stopper tab 252 is disposed opposite a second engaging tab 246, the second engaging tab 246 is disposed adjacent to one of the first and second end panels 216, 218. The second stopper tab 252 of a first endmost article retention structure RT1 is disposed back-to-back with a second stopper tab 252 of a second, adjacent, intermediate article retention structure RT2 each second stopper tab 252 defining a recess in the article receiving opening of the respective article retention structure RT1, RT2.

A third stopper tab 256 is disposed opposite a second full tooth 240*b*.

The intermediate article retention structures RT2 comprise four additional stopping tabs 248, 252, 256.

A first stopper tab 248 is disposed opposite a first engaging tab 250, the first engaging tab 250 is disposed adjacent to one of the first and second side panels 220, 222. The first stopper tab 248 of a first endmost article retention structure RT1 is disposed back-to-back with a first stopper tab 248 of a second, adjacent, endmost article retention structure RT1 each defining a recess in the article receiving opening of the respective endmost article retention structure RT1.

The intermediate article retention structures RT2 comprise a pair of second stopper tabs 252 disposed diametrically opposite each other. Each of the pair of second stopper tabs 252 of a first intermediate article retention structure RT2 is disposed back-to-back with a second stopper tab 252 of an adjacent article retention structure RT1, RT2 (either an endmost article retention structure RT1 or an intermediate article retention structures RT2) each second stopper tab 252 defining a recess in the article receiving opening of the respective retention structure RT1, RT2.

A third stopper tab 256 is disposed opposite a second full tooth 240*b*.

Referring now to FIGS. 7A to 12 there is shown further alternative embodiments of the present disclosure. In the illustrated embodiments, like numerals have, where possible, been used to denote like parts, albeit with the addition of the prefix "300"; "400" to indicate that these features belong to the fourth and fifth embodiments respectively. The alternative embodiments share many common features with the embodiment of FIGS. 1 to 6, therefore only the differences from the embodiment illustrated in FIGS. 1 to 6 will be described in any greater detail.

Figure 7A:
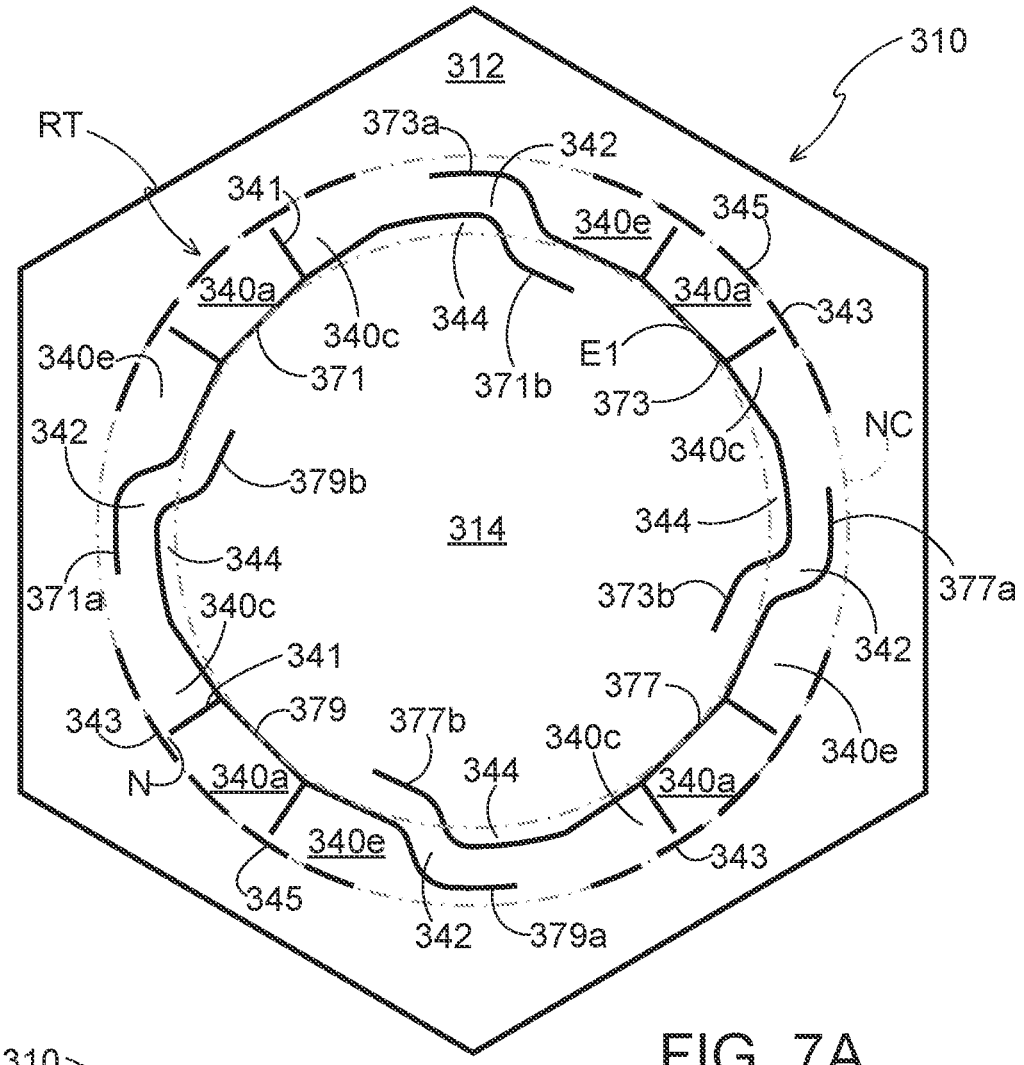
FIG. 7A is a plan view from above of a blank for forming a package according to a yet a further embodiment of the present disclosure.
Figure 7B:
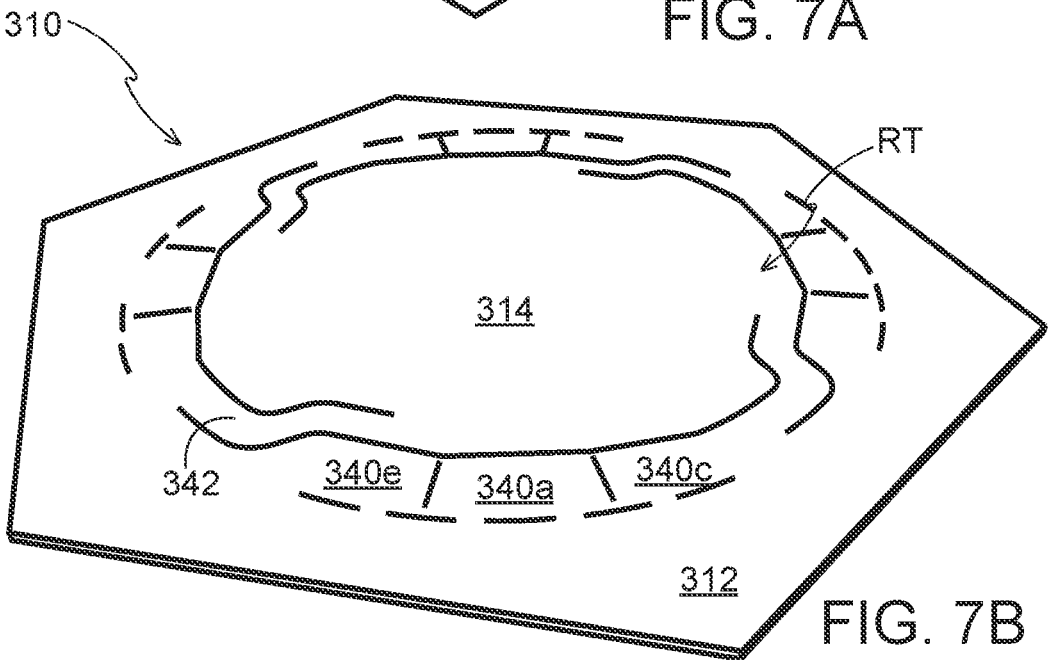
FIG. 7B is a perspective view from above of the blank of FIG. 7A.
Figure 8:
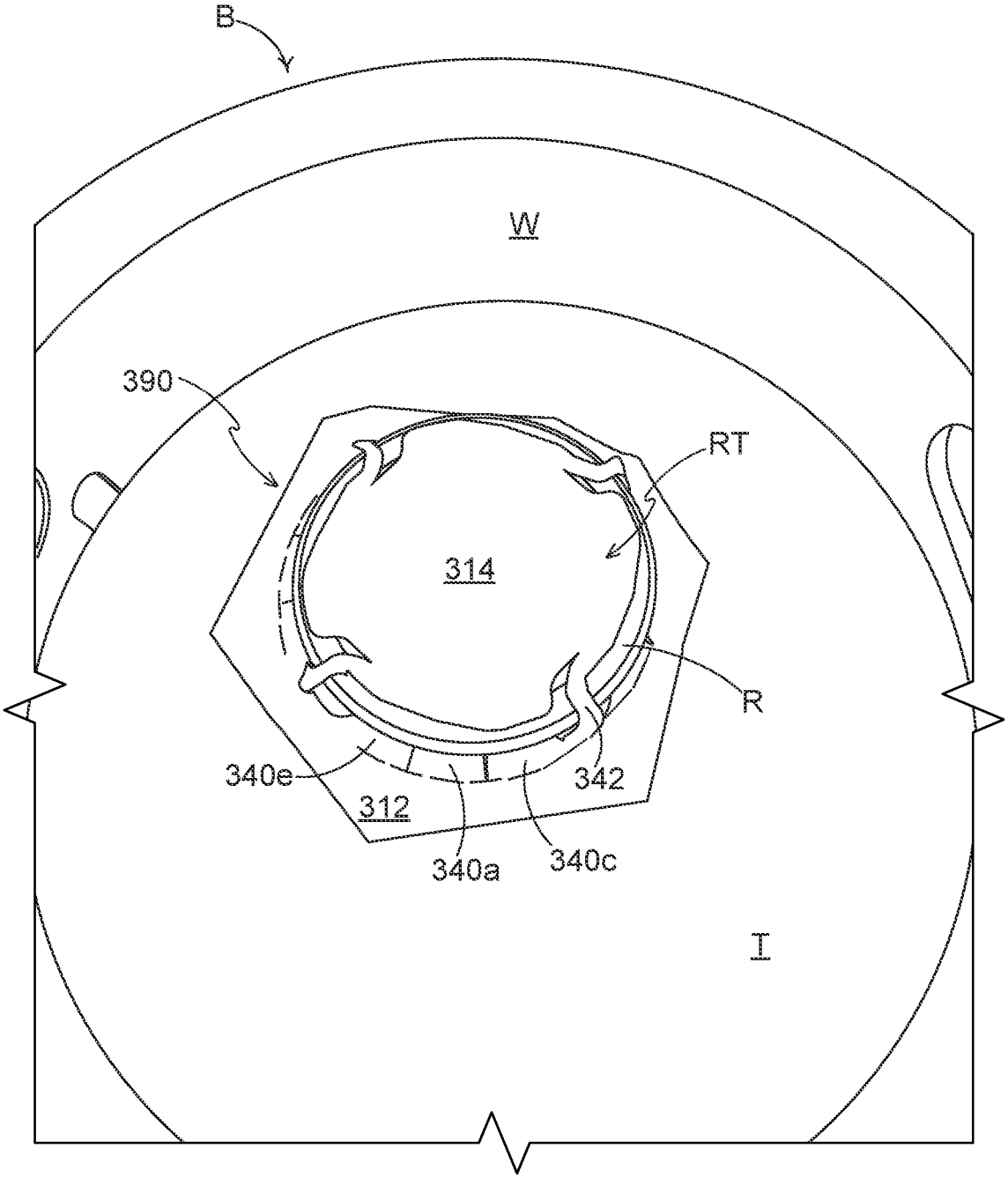
FIG. 8 is a perspective view from above of a package formed from the blank of FIG. 7A.

FIGS. 7A and 7B show a blank 310 comprising a main panel 312 forming an engaging panel 312 of an article engaging device 390 (see FIG. 8). The device of FIG. 8 is an identification tag such as a keg collar. Optionally, the main panel 312 is hexagonal in shape, in other embodiments other shapes may be employed such as, but not limited to, square, pentagon, octagon, dodecagon, hexadecagon, and circle.

The main panel 312 comprises a single article engaging structure RT. The article engaging structure RT comprises an article receiving opening defined in part by a cover panel 314.

The article engaging structure RT comprises a plurality of engaging teeth 340*a*, 340*c*, 340*e* disposed about the cover panel 314 and defining a perimeter of the article receiving opening.

The plurality of teeth 340*a*, 340*c*, 340*e* are hinged to the main panel 312 by a fold line. The fold line may be defined by a plurality of cut lines 343, 345. The plurality of cut lines 343, 345 may define or approximate a circle or part thereof.

The article engaging structure RT may comprise a plurality of first full teeth 340*a* disposed about the cover panel 314. Each first tooth 340*a* comprises an engaging edge E1 opposing a hinged edge. The engaging edges E1 are defined by a linear portion of a cut line defining the cover panel 314. Each engaging edge E1 defines a part of a polygon such as but not limited to a hexadecagon. In some embodiments, the cut line defining the cover panel 314 may be arcuate, at least in part, in shape. Each full tooth 340*a* comprises a pair of side edges, the side edges are defined by cut lines 341 extending radially outward from respective vertices of the polygon. That is to say from a respective vertex between a pair of adjacent linear portions of the cut line defining the cover panel 314. The cut lines 341 are divergently arranged with respect to each other and define an angle therebetween, the angle may be about 22.5°.

The article engaging structure RT may comprise a plurality of first circumferential cut lines 343. Each of the plurality of first circumferential cut lines 343 is aligned with one of the radial cut lines 341 such that said one of the radial cut lines 341 or a notional extension thereof bisects a respective one of the plurality of first circumferential cut lines 343.

The first full teeth 340*a* may comprise a pair of first circumferential cut lines 343 that is spaced apart from a respective radial cut line 341 bisecting it so as to define a connecting nick or bridge portion N between a pair of adjacently disposed teeth 340*a*, 340*c*, 340*e*. Each of the plurality of first circumferential cut lines 343 may be linear in shape. Alternatively, each of the plurality of first circumferential cut lines 343 may be non-linear or arcuate in shape.

The article engaging structure RT may comprise a plurality of second circumferential cut lines 345. Each of the plurality of second circumferential cut lines 345 is disposed between a pair of the plurality of first circumferential cut lines 343 and is spaced apart therefrom so as to define a pair of connecting nick or bridge portions between a tooth 340*a*, 340*c*, 340*e* and the main panel 312. The pair of connecting nick or bridge portions provide a hinged or foldable connection between each tooth 340*a*, 340*c*, 340*e* and the main panel 312. Each of the plurality of second circumferential cut lines 345 may be linear in shape. Alternatively, each of the plurality of second circumferential cut lines 345 may be non-linear or arcuate in shape.

In the illustrated embodiment, the radius of curvature of each of the plurality of second circumferential cut lines 345 is equal to the radius of curvature of each of the plurality of first circumferential cut lines 343 however in other embodiments it may be different.

The article engaging structure RT comprises at least one, two or more connecting teeth 340*c*. The illustrated embodiment comprises a four connecting teeth 340*c*, each is coupled or connected to a bridging or connecting portion 342. In the illustrated embodiment, a first or proximal end of the bridging or connecting portion 342 is coupled in part to a connecting tooth 340*c* and in part to the main panel 312. The first end of the bridging or connecting portion 342 may be connected to a side edge of a connecting tooth 340*c*; the side edge being disposed adjacent to an engaging edge of the connecting tooth 340*c*. A second or distal end of the bridging or connecting portion 342 is coupled or connected directly to the cover panel 314. The bridging or connecting portion 342 may be substantially "Z" or 'S" shaped. The bridging or connecting portion 342 comprises a generally radially extending section and a generally circumferential extending portion.

The cover panel 314 comprises at least one stopper tab 344 providing an end stop against which the article B may abut. The stopper tab 344 may abut or engage a rim of a port of the article B. In the illustrated embodiment, the article B comprises a fill port C (also known as a "bung'), best shown in FIG. 12. The port C comprises a self-closing valve; this may take the form of a ball bearing held in closed configuration by fluid pressure within the article B. The port C is adapted to receive a coupler for filling the article B with product and for dispensing the product from within the article B. In the illustrated embodiment, the blank 310 comprises a plurality of stopper tabs 344, specifically, but not limited to, four stopper tabs 344. Pairs of stopper tabs 344 are arranged to be substantially opposite each other, that is to say they are diametrically opposed.

The bridging or connecting portion 342 may be arranged to be contained within a notional circle NC defining the hinged connection between the plurality of teeth 340*a*, 340*c*, 340*e* and the main panel 312. That is to say the bridging or connecting portion 342 is contained within the footprint of the plurality of teeth 340*a*, 340*c*, 340*e*. A portion 371*a*, 373*a* of a cutline 371, 373 defining an outermost edge of the connecting portion 342 is offset with respect to the notional circle NC defining said hinged connection.

At least a portion of a cutline 371*b*, 373*b* defining an inner edge of the connecting portion 342 also defines, at least in part, the stopper tab 344; the connecting portion 342 and the stopper tab 344 share a common cutline. The stopper tab 344 is nested or tessellated within the connecting portion 342. The stopper tab 344 is disposed, at least in part, between a radially extending portion of the connecting portion 342 and the connecting tab 340*c* to which the connecting portion 342 is connected.

A partial tooth 340*e* may abut, or be disposed adjacent to, the radially extending portion of the connecting portion 342.

FIG. 8 shows the blank 310 mounted to an article B to form an engaging device such as a cap 390. The cap 390 comprises a cover panel 314 to protect the port C of the article B which optionally is a beverage keg. This may prevent or inhibit ingress of dust, dirt, or other foreign objects into the port C. The cap 390 may also provide a surface for display of information, advertising, or branding.

When engaged with the port C, the cover panel 314 is displaced outwardly from the main panel 312, along with the connecting portions or bridging strips 342 and the teeth 340*a*, 340*c*, 340*e*. The teeth 340*a*, 340*c*, 340*e* engage with a flange, projection, or lip of the port C to inhibit removal or separation of the cap 390 from the article B.

Figure 9A:
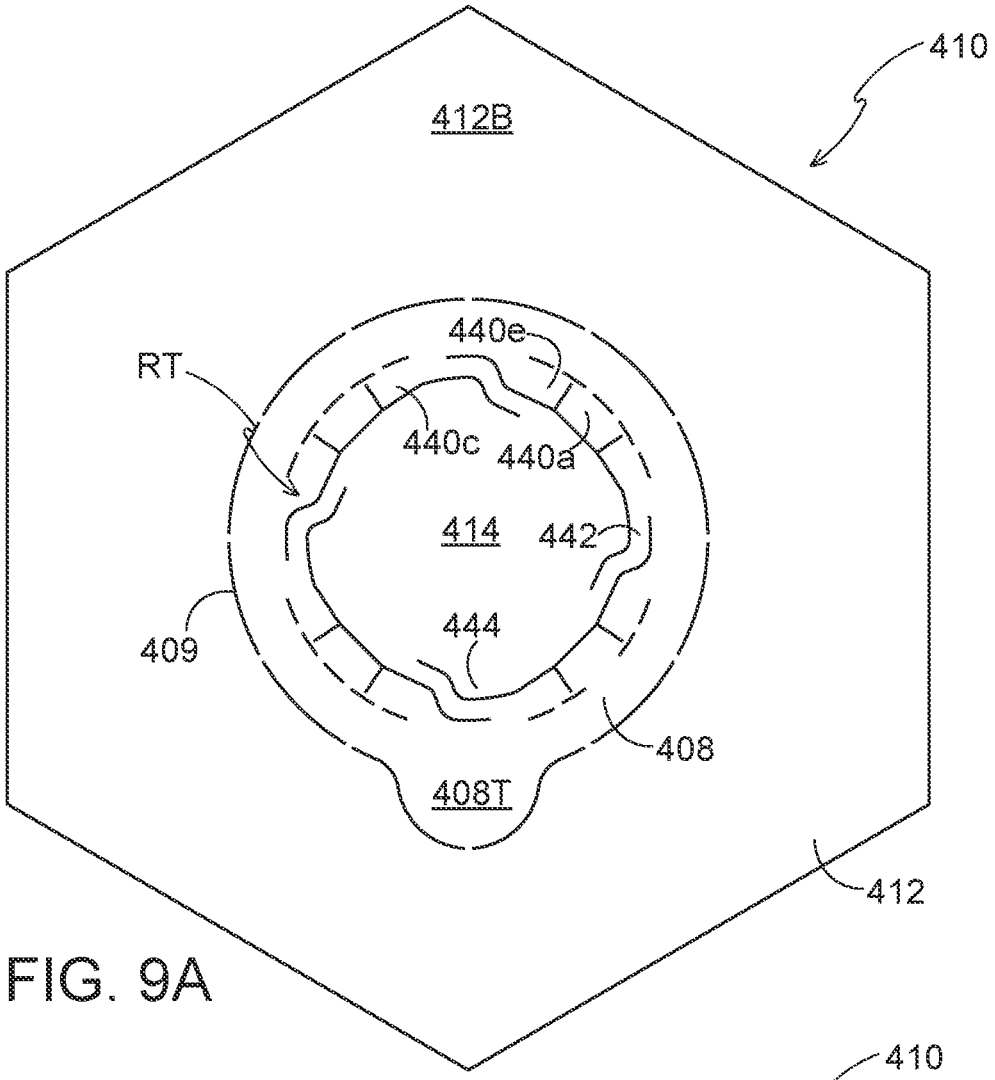
FIG. 9A is a plan view from above of a blank for forming a package according to a still yet a further embodiment of the present disclosure.
Figure 9B:
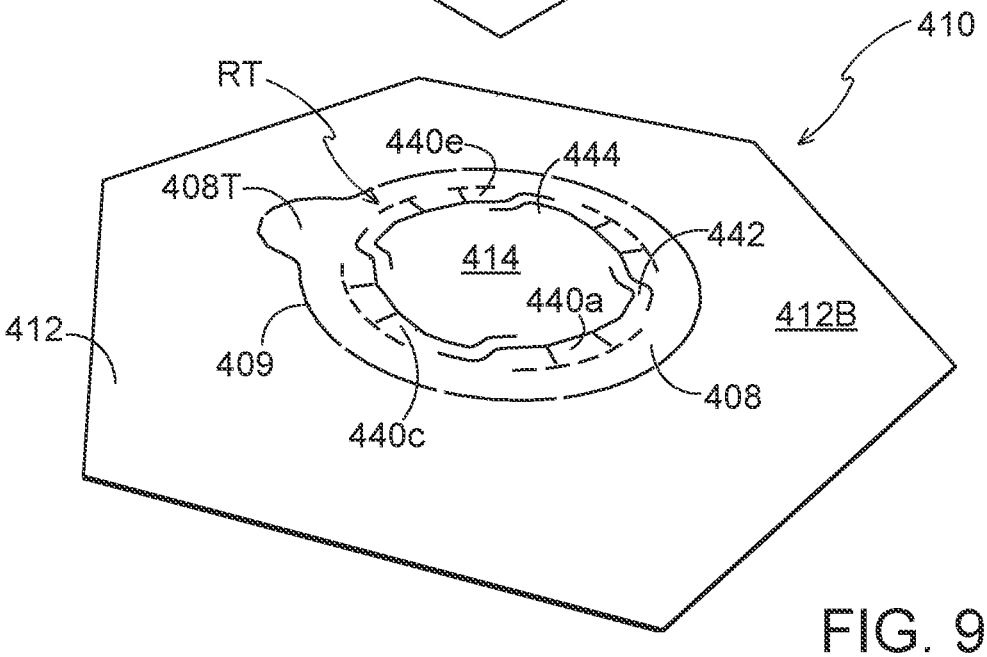
FIG. 9B is a perspective view from above of the blank of FIG. 9A.

FIGS. 9A and 9B show a blank 410, according to another embodiment, comprising a main panel 412 forming an engaging panel 412 of an article engaging device 490 (see FIG. 10) which may optionally be an identification tag having a cap incorporated into it. Optionally, the main panel 412 is hexagonal in shape, in other embodiments other shapes may be employed such as, but not limited to, square, pentagon, octagon, dodecagon, hexadecagon, and circle. The main panel 412 is larger in dimension than that of the embodiment of FIGS. 7A and 7B.

The main panel 412 comprises a single article engaging structure RT substantially similar in construction to the article engaging structure RT of FIGS. 7A and 7B and will not be described in further detail.

Figure 10:
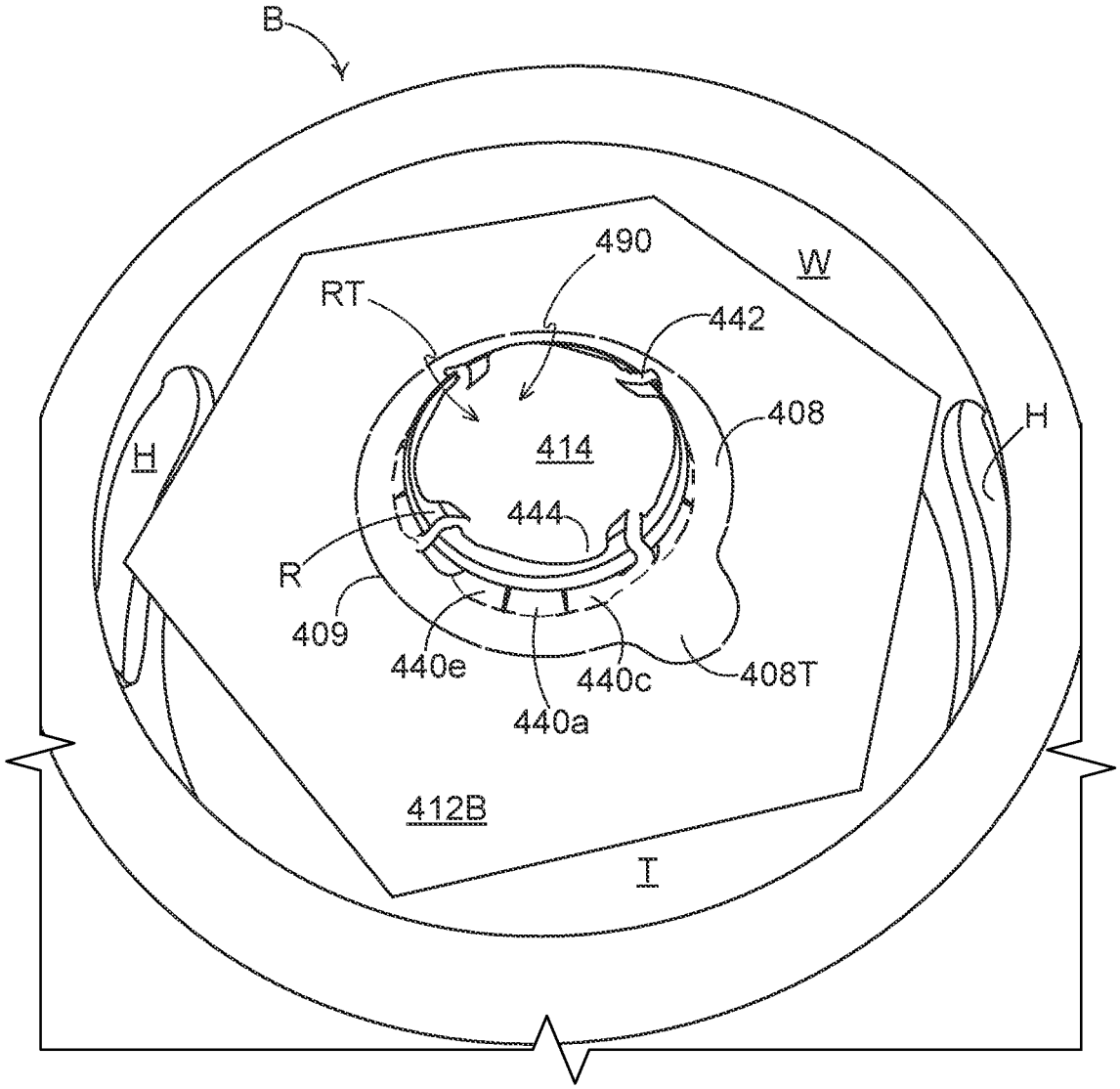
FIG. 10 is a perspective view from above of a package formed from the blank of FIG. 9A.
Figure 11:
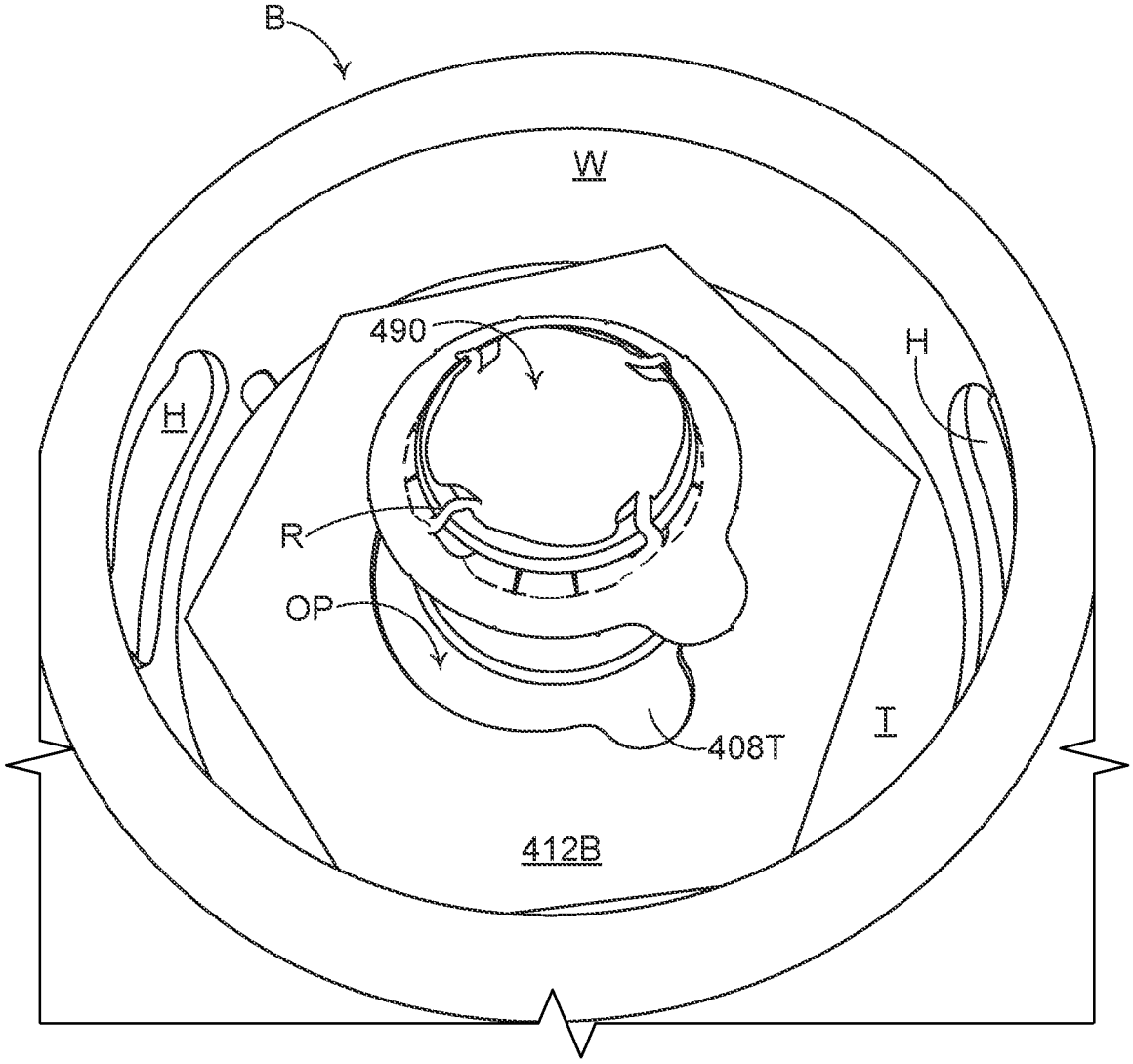
FIG. 11 is another perspective view from above of a package formed from the blank of FIG. 9A.
Figure 12:
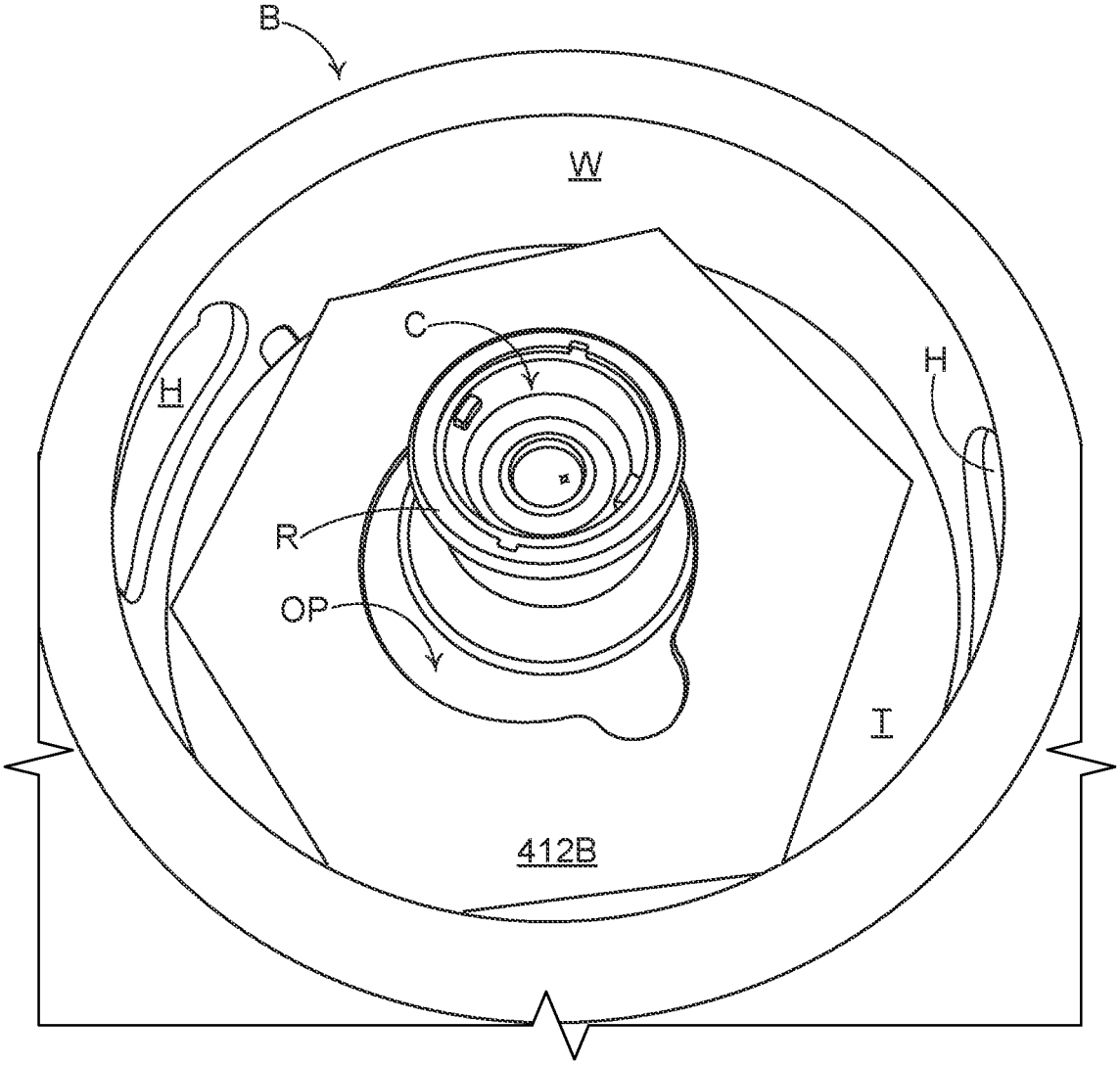
FIG. 12 is a perspective view from above of a package formed from the blank of FIG. 9A in an opened condition.

The article engaging structure RT is surrounded by a frangible or severable line 409 defining a detachable portion 408 of the main panel 412. The detachable portion 408 and the article engaging structure RT provided therein form a cap or cover 490 for a port C of an article B as shown in FIGS. 10 and 11. The article B may optionally be a beverage keg, The portion of the main panel 412 outside the severable line 409 forms a collar 412B. The collar 412B is separable or detachable along the severable line 409 from the cap 490 as shown in FIGS. 11 and 12. In FIG. 12, the cap 490 has been removed from the port C.

Separation or detachment of the cap 490 along the severable line 409 from the main panel 412 creates an opening OP in the main panel 412, the opening OP is sufficiently large to accommodate the port C such that the collar 412B can sit upon a top panel T of the article B with the port C passing through the opening OP. The main panel 412 is dimensioned so as to be accommodated within a recess or orifice in the top of the article B. The recess in the article B provides upstanding annular wall having one or more handle openings H.

The severable line 409 may be shaped to provide a tab 408T, the tab 408T may provide a handle for facilitating removal of the cap 490 from the port C.

The collar 412B may serve as an identification tag for providing an additional surface for display of information, advertising, or branding, advantageously the information remains mounted to the article B after removal of the cap 490.

Figure 13:
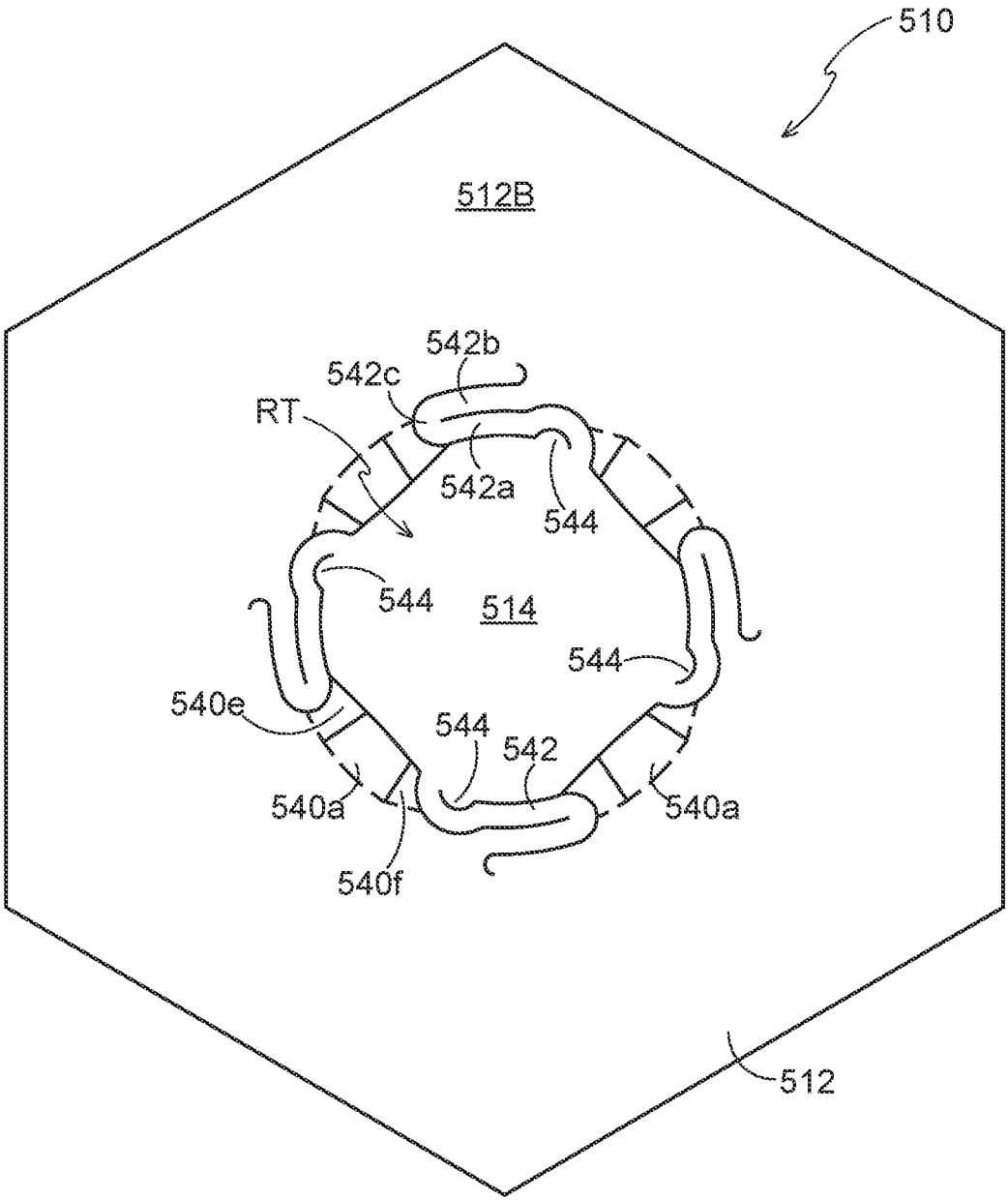
FIG. 13 is a plan view from above of a blank for forming a carrier according to yet another embodiment of the present disclosure.
Figure 13B:
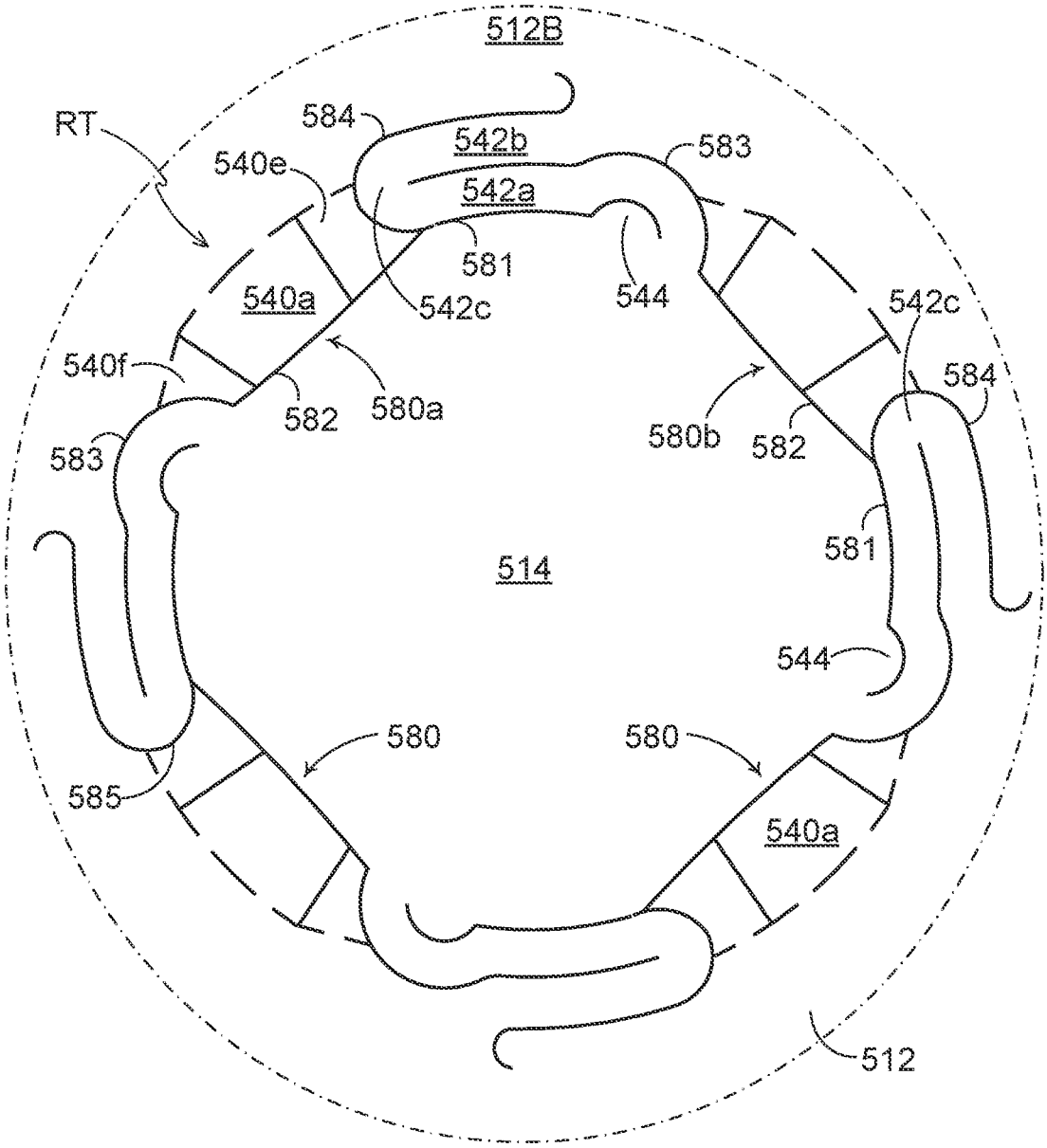
FIG. 13B is a detailed plan view from above of an article retention device of the blank of FIG. 13.
Figure 14:
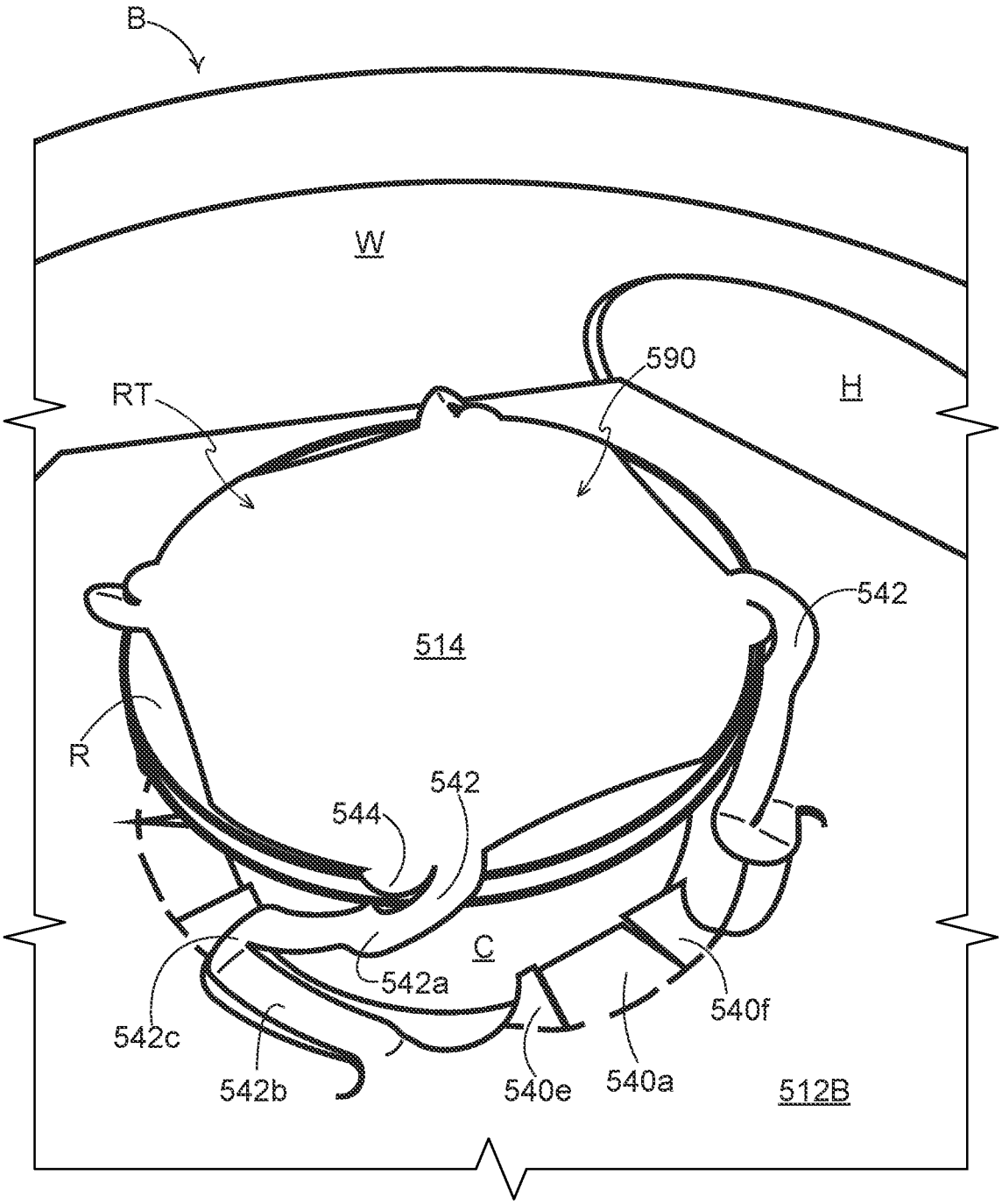
FIG. 14 is a perspective view from above of a package formed from the blank of FIG. 14.

Referring now to FIGS. 13 and 14 there is shown an additional embodiment of the present disclosure. In the illustrated embodiment, like numerals have, where possible, been used to denote like parts, albeit with the addition of the prefix "500" to indicate that these features belong to the sixth embodiment respectively. The alternative embodiment shares many common features with the previous embodiments, therefore only the differences from the embodiment illustrated in FIGS. 1 to 12 will be described in any greater detail.

FIG. 13 shows a blank 510 comprising a main panel 512 forming an engaging panel 512 of an article engaging device 590 (see FIG. 14). The engaging panel 512 serves as an identification tag such as a keg collar while the cover panel 514 serves as a cap for covering the spout/valve/port of the keg as shown in FIG. 14. Optionally, the main panel 512 is hexagonal in shape, in other embodiments other shapes may be employed such as, but not limited to, square, pentagon, octagon, dodecagon, hexadecagon, and circle.

The main panel 512 comprises a single article engaging structure RT. The article engaging structure RT comprises an article receiving opening defined in part by a cover panel 514. The cover panel 514 is struck from the main panel 512.

The article engaging structure RT comprises a plurality of engaging teeth 540*a*, 540*e*, 540*f* disposed about the cover panel 514 and defining a perimeter of the article receiving opening.

The plurality of teeth 540*a*, 540*e*, 540*f* are hinged to the main panel 512 by a fold line. The fold line may be defined by a plurality of cut lines.

The article engaging structure RT comprises at least a pair of first and second non-linear slits 580*a*, 580*b* each comprising first and second opposite end sections 581, 583 and an intermediate section 582. The illustrated embodiment comprises four non-linear slits 580, 580*a*, 580*b*. The first and intermediate sections 581, 583 of each of the first and second non-linear slits 580*a*, 580*b* define part of the cover panel 514. The first end section 581 of the first slit 580*a* is disposed at a position radially inside of the second end section 583 of the second slit 580*b*. The intermediate section 582 of each of the first and second non-linear slits 580*a*, 580*b* defines a radially inner, distal, free, or engaging end edge of at least one of the engaging teeth 540*a*, 540*e*, 540*f*.

The first end section 581 of the first slit 580*a* and the second end section 583 of the second slit 580*b* extend alongside one another, albeit spaced apart, to define a bridging strip 542 therebetween for connecting between the cover panel 514 and the main panel 512 or in alternative embodiments one of the engaging teeth 540*a*, 540*e*, 540*f*.

The bridging strip 542 comprises a first part or section 542*a* that extends generally circumferentially with respect to the article receiving opening. The bridging strip 542 comprises a second part or section 542*b* that extends generally circumferentially with respect to the article receiving opening and is disposed radially outwardly of the first section 542*a* (that is to say the second part or section 542*b* is further from the centre of the article receiving opening than the first part or section 542*a*). The first section 542*a* and the second section 542*b* are coupled together by a third part or section 542C, the third section 542*b* extends generally radially with respect to the article receiving opening. This arrangement may be advantageous to allow the main panel 512 to be spaced further apart (at a lower, or upper, elevation) from the cover panel 514 when applied to the article without requiring the bridging strip 542 to extend significantly beyond the article receiving opening in a radial direction. In this way the article engaging structure RT has a compact footprint.

At least one of the engaging teeth 540*a*, 540*e*, 540*f* has a side edge defined by a radial cut 585 extending generally radially with respect to the article receiving opening. The radial cut 585 extends from the intermediate section 582 of a respective one of the first and second non-linear slits 580*a*, 580*b*.

The first non-linear slit 580*a* comprises a branch section 584 extending from the first end section 581 of the first non-linear slit 580*a*. At least part of the branch section 584 is disposed at a position radially outside of the second end section 583 of the second slit 580*a* and extends therealongside.

The cover panel 514 comprises at least one stopper tab 544 for resting on an article rim R (see FIG. 15). The at least one stopper tab 544 extends radially outward from the cover panel 514 and is defined at least in part by the first end section 581 of the first non-linear slit 580*a*. The illustrated embodiment comprises four stopper tabs 544 each defined by a first end section 581 of a non-linear slit 580.

The stopper tab 544 defines a recess in the bridging strip 542, the recess may engage with, or receive, a rim, ridge, projection, or lip extending radially outward from the port C and circumferentially, at least partially, thereabout. In this way the device 590 may be secured to the port C.

The main panel 512 of the device or keg collar 590 may be held above the top (not shown in FIG. 15) of the article B, barrel, or keg. The main panel 512 may not be in direct contact with the article top, at least initially, this may change as the device or keg collar 590 ages or absorbs moisture.

The engaging teeth 540*a*, 540*e*, 540*f* may be configured to engage a sidewall of the port C to stabilise the device 590.

The present disclosure provides a carrier 90; 190; 390; 490, 590 of the top engaging type having article retention or engaging structures RT; RT1, RT2 for engaging articles B and a blank 10; 110; 210; 310; 410; 510 for forming the article carrier 90; 190; 390; 490; 590.

The carrier 90; 190; 390; 490; 590 comprises a main panel 12; 112; 212; 312; 412; 512 having one or more article retention structures or engaging structures RT; RT1, RT2 for receiving and securing the main panel 12; 112; 212; 312; 412; 512 to a respective article B.

The present disclosure provides an article retention structure or engaging structure RT; RT1, RT2 having an article receiving opening defined in part by a plurality of engaging teeth 40*a*, 40*b*, 40*c*, 40*d*, 40*e*; 140*b*, 140*c*, 140*e*; 240*b*, 246, 250; 340*a*, 340*c*, 340*e*; 440*a*, 440*c*, 440*e*; 540*a*, 540*e*, 540*f*. The article retention structures RT; RT1, RT2 comprise a cover panel 14; 114; 214; 314; 414; 514 coupled to the main panel 12; 112; 212; 312; 412; 512 by at least one, two or more bridging strips 42; 142; 242; 342; 442; 542. Each bridging strip 42; 142; 242; 342; 442; 542 extends from an engaging or connecting tooth 40*c*, 40*d*; 140*c*; 240*c*; 340*a*, 340*c*, 340*e*; 440*a*, 440*c*, 440*e*; 540*a*, 540*e*, 540*f* and is directly connected to the cover panel 14; 114; 214; 314; 414; 514. This may be advantageous for maintaining the engaging or connecting tooth 40*c*, 40*d*; 140*c*; 240*c*; 340*a*, 340*c*, 340*e*; 440*a*, 440*c*, 440*e*; 540*a*, 540*e*, 540*f* in engagement with an article B when received in the article engaging structure RT; RT1, RT2. This arrangement may prevent or mitigate against the engaging or connecting tooth 40*c*, 40*d*; 140*c*; 240*c*; 340*a*, 340*c*, 340*e*; 440*a*, 440*c*, 440*e*; 540*a*, 540*e*, 540*f* being pulled radially outwards by the bridging strip 42; 142; 242; 342; 442; 542 away from the article B and thus disengaged from the article B.

The present disclosure provides an article retention structure or engaging structure RT; RT1, RT2 having a cover panel 14; 214; 314; 414; 514 and at least one stopper tab 44; 244, 248, 252, 256; 344; 444; 544 (for resting on an article rim or ledge) having an outer free end which is defined by a first end section 71*b*, 73*b*; 371*b*, 373*b*, 377*b*, 379*b*; 581 of a first arcuate slit 71, 73; 371, 373, 377, 379; 580*a*. The outer free end is adjoined by a bridging strip 42; 142; 242; 342; 442; 542 and is separated therefrom by the first end section 71*b*, 73*b*; 371*b*, 373*b*, 377*b*, 379*b*; 581.

The present disclosure provides an article retention structure or engaging structure RT; RT1, RT2 having a cover panel 14; 214; 314; 414; 514 and at least one stopper tab 44; 244, 248, 252, 256; 34; 444; 544 having an outer free end defined by a first end section 71*b*; 371*b*, 373*b*, 377*b*, 379*b*; 581 of a first arcuate slit 71, 371, 373, 377, 379; 580*a*. The outer free end is radially spaced apart from a second end section 73*a*; 373*a*, 377*a*, 379*a*, 371*a*; 583 of a second arcuate slit 73; 373, 377, 379, 371; 580*b* such that a bridging strip 42; 142; 242; 342; 442; 542 is defined between the first end section 71*b*; 371*b*, 373*b*, 377*b*, 379*b*; 581 and the second end section 73*a*; 373*a*, 377*a*, 379*a*, 371*a*; 583.

The present disclosure provides a top engaging device RT; RT1, RT2 comprising a pair of opposing, essentially arcuate, slits 71, 73. A first end section 71*b* of a first slit 71 is disposed at a position radially inside of a second end section 73*a* of a second slit 73. A second end section 71*a* of the first slit 71 is disposed at a position radially outside of a first end section 73*b* of the second slit 73.

In some embodiments, there is provided an article carrier 90; 190 comprising a main panel 12; 112; 212 having a top engaging device RT, RT1, RT2 from which one or more articles B may be suspended.

In other embodiments, there is provided an article cover or cap 390; 490; 590 comprising a main panel 312; 412; 512 having an engaging device RT mounted to an article B for providing a display region or dust cap.

The present disclosure also provides an article engaging device 90; 190; 390; 490; 590 comprising an article retention structure or engaging structure RT; RT1, RT2 for engaging at least one article B. The device 90; 190; 390; 490; 590 comprises a main panel 12; 112; 212; 312, 412; 512 comprising the engaging structure RT; RT1, RT2. The engaging structure RT; RT1, RT2 comprises a top-receiving opening defined in part by a plurality of engaging teeth 40*a*, 40*b*, 40*c*, 40*d*, 40*e*; 140*b*, 140*c*, 140*e*; 240*b*, 246, 250; 340*a*, 340*c*, 340*e*; 440*a*, 440*c*, 440*e*; 440*a*, 440*e*, 440*f* disposed partially around the top-receiving opening. The device 90; 190; 390; 490; 590 comprises a cover panel 14; 114; 214; 314; 414; 514 struck from the main panel 12; 112; 212; 312, 412; 512 to define the top-receiving opening, at least in part. The engaging structure RT; RT1, RT2 further comprises at least a pair of first and second non-linear slits 71, 73; 371, 373; 580*a*, 580*b* each comprising first and second opposite end sections 71*b*, 71*a*, 73*b*, 73*a*; 371*b*, 371*a*, 373*b*, 373*a*; 581, 583 and an intermediate section 71, 73; 371, 373; 582. The first and intermediate sections 71*b*, 71, 73*b*, 73; 371*b*, 371, 373*b*, 373; 581, 582 of each of the first and second non-linear slits 71, 73; 371, 373; 580*a*, 580*b* define part of the cover panel 514. The first end section 71*b*, 73*b*; 371*b*, 373*b*; 581 of the first slit 71; 371; 580*a* is disposed at a position radially inside of the second end section 73*a*; 373*a*; 583 of the second slit 73; 373; 580*b*. The intermediate section 71, 73; 371, 373; 582 of each of the first and second non-linear slits 71, 73; 371, 373; 580*a*, 580*b* defines a radially inner or distal end of at least one of the engaging teeth 40*a*, 40*b*, 40*c*, 40*d*, 40*e*; 140*b*, 140*c*, 140*e*; 240*b*, 246, 250; 340*a*, 340*c*, 340*e*; 440*a*, 440*c*, 440*e*; 440*a*, 440*e*, 440*f*.

The blanks 10; 110; 210; 310; 410; 510 include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) SBS board (solid bleached sulphate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210; 310; 410; 510 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin, or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

It can be appreciated that various changes may be made within the scope of the present invention. For example, the size and shape of the panels and apertures may be adjusted to accommodate articles of differing size or shape. The shoulder panels may be omitted. The present invention is not limited to cartons of the top-engaging type, the invention may be employed with other carton styles such as, but not limited to, open top crates, lidded or closed top crates.

It will be recognised that as used herein, directional references such as "top", "bottom", "base", "front", "back", "end", "side", "inner", "outer", "upper" and "lower" do not necessarily limit the respective panels to such orientation but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a main panel is "in registry with" a second aperture in a second panel that is placed in an overlapping arrangement with the main panel, an edge of the aperture may extend along at least a portion of an edge of the second aperture and may be aligned, in the direction of the thickness of the first and second panels, with the second aperture.

The invention claimed is:

1. An article engaging device for engaging at least one article, comprising a main panel having at least one article retention structure for engaging the at least one article, the at least one article retention structure having an article receiving opening defined in part by a plurality of engaging teeth and comprising a cover panel coupled to the main panel by at least one bridging strip, wherein the at least one bridging strip extends from at least one of the engaging teeth of the main panel to the cover panel so as to form a connection between the cover panel and the main panel that is configured to be maintained in use with the at least one article retention structure engaging the at least one article.

2. An article engaging device according to claim 1, comprising a stopper tab nested within at least a portion of the at least one bridging strip.

3. An article engaging device according to claim 1, wherein the at least one bridging strip is directly connected in part to the main panel and to the cover panel.

4. An article engaging device according to claim 1, wherein the at least one bridging strip extends radially outward of a notional circle defined by a hinged connection between the plurality of engaging teeth and the main panel.

5. An article engaging device according to claim 1, wherein the at least one bridging strip is disposed within a notional circle defined by a hinged connection between the plurality of engaging teeth and the main panel.

6. An article engaging device according to claim 1, wherein the at least one bridging strip comprises at least one pair of diametrically opposed bridging strips.

7. An article engaging device according to claim 1 wherein the cover panel comprises at least one stopper tab for resting on an article rim and extending radially outward from the cover panel, the at least one stopper tab having an outer free end which is defined by a first end section of a first arcuate slit, wherein the outer free end is adjoined by the bridging strip and is separated therefrom by the first end section.

8. An article engaging device according to claim 7 wherein the outer free end is radially spaced apart from a second end section of a second opposing arcuate slit such that the bridging strip is defined between the first end section and the second end section.

9. An article engaging device according to claim 1 wherein the main panel comprises a pair of opposing, generally arcuate slits, wherein a first end section of the first slit is disposed at a position radially inside of a second end section of the second slit, and wherein a second end section of the first slit is disposed at a position radially outside of a first end section of the second slit.

10. An article engaging device according to claim 1, wherein the at least one bridging strip has an inner end which is connected to the cover panel, and wherein the inner end is disposed within a notional circle defined by a hinged connection between the plurality of engaging teeth and the main panel.

11. An article engaging device according to claim 10, wherein the at least one bridging strip has an outer end opposite to the inner end, wherein the at least one bridging strip is connected at the outer end to the at least one engaging teeth among the plurality of the engaging teeth and wherein the inner end is disposed closer to a centre of the article receiving opening than the outer end.

12. An article engaging device according to claim 1, wherein the cover panel remains integrally connected to the main panel via the bridging strip.

13. An article engaging carrier for packaging articles, the carrier comprising a main panel having at least two article retention structures for engaging an article, each of the at least two article retention structures having an article receiving opening defined in part by a plurality of engaging teeth and comprising a cover panel coupled to the main panel by at least one bridging strip, wherein the at least one bridging strip of each of the at least two article retention structures extends from at least one of the engaging teeth of the main panel to a respective cover panel so as to form a connection between the cover panel and the main panel that is configured to be maintained in use with the at least two article retention structures engaging the article, and wherein the at least one bridging strip of a first one of the at least two article retention structures is disposed back to back with the at least one bridging strip of a second one of the at least two article retention structures.

14. An article engaging carrier according to claim 13 wherein the cover panel of a first one of the at least two article retention structures comprises a first stopper tab extending radially therefrom and the cover panel of a second one of the at least two article retention structures comprises a second stopper tab extending radially therefrom, the second stopper tab being disposed back to back with the first stopper tab.

15. A blank for forming an article engaging device, the blank comprising a main panel having at least one article retention structure for engaging at least one article, the at least one article retention structure having an article receiving opening defined in part by a plurality of engaging teeth and comprising a cover panel coupled to the main panel by at least one bridging strip, wherein the at least one bridging strip extends from at least one of the engaging teeth of the main panel to the cover panel so as to form a connection between the cover panel and the main panel that is configured to be maintained in use with the at least one article retention structure engaging the at least one article.

16. A blank according to claim 15 wherein the cover panel comprises at least one stopper tab for resting on an article rim and extending radially outward from the cover panel, the at least one stopper tab having an outer free end which is defined by a first end section of a first arcuate slit, wherein the outer free end is adjoined by the bridging strip and is separated therefrom by the first end section.

17. A blank according to claim 16 wherein the outer free end is radially spaced apart from a second end section of a second opposing arcuate slit such that the bridging strip is defined between the first end section and the second end section.

18. A blank according to claim 15 wherein the main panel comprises a pair of opposing, generally arcuate, slits, wherein a first end section of the first slit is disposed at a position radially inside of a second end section of the second slit, and wherein a second end section of the first slit is disposed at a position radially outside of a first end section of the second slit.

19. A blank for forming an article carrier, the blank comprising a main panel having at least two article retention structures for engaging an article, each of the at least two article retention structures having an article receiving opening defined in part by a plurality of engaging teeth and comprising a cover panel coupled to the main panel by at least one bridging strip, wherein the at least one bridging strip of each of the at least two article retention structures extends from at least one of the engaging teeth of the main panel to the cover panel so as to form a connection between the cover panel and the main panel that is configured to be maintained in use with the at least two article retention structures engaging the article, and wherein the at least one bridging strip of a first one of the at least two article retention structures is disposed back to back with the at least one bridging strip of a second one of the at least two article retention structures.

20. A blank according to claim 19 wherein the cover panel of a first one of the at least two article retention structures comprises a first stopper tab extending radially therefrom and the cover panel of a second one of the at least two article retention structures comprises a second stopper tab extending radially therefrom, the second stopper tab being disposed back to back with the first stopper tab.

* * * * *